US007641326B2

(12) United States Patent
Umeda et al.

(10) Patent No.: US 7,641,326 B2
(45) Date of Patent: Jan. 5, 2010

(54) INK JET RECORDING APPARATUS

(75) Inventors: Takaichiro Umeda, Nagoya (JP); Hiroaki Yazawa, Nagoya (JP); Hisaki Sakurai, Aichi-ken (JP); Hikaru Kaga, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 400 days.

(21) Appl. No.: 11/386,095

(22) Filed: Mar. 22, 2006

(65) Prior Publication Data

US 2006/0227181 A1 Oct. 12, 2006

(30) Foreign Application Priority Data

Mar. 22, 2005 (JP) ..... 2005-081299

(51) Int. Cl.
*B41J 2/17* (2006.01)
*B41J 2/175* (2006.01)

(52) U.S. Cl. ..... 347/84; 347/85

(58) Field of Classification Search ..... 347/20, 347/84, 5, 7, 86, 85
See application file for complete search history.

(56) References Cited

U.S. PATENT DOCUMENTS 6,273,545 B1 * 8/2001 Oide ..... 347/24
6,312,089 B1 * 11/2001 Imai ..... 347/24
6,486,901 B1 * 11/2002 DeBoer et al. ..... 346/140.1
2002/0101487 A1 * 8/2002 Petersen et al. ..... 347/85
2002/0158943 A1 * 10/2002 Powell et al. ..... 347/49
2003/0007040 A1 * 1/2003 Love et al. ..... 347/85
2003/0071874 A1 * 4/2003 Ishizawa et al. ..... 347/50
2003/0122905 A1 * 7/2003 Suzuki et al. ..... 347/85
2003/0132980 A1 * 7/2003 Yamazaki et al. ..... 347/19
2003/0146945 A1 * 8/2003 Inui et al. ..... 347/7

FOREIGN PATENT DOCUMENTS

JP 6-293142 10/1994
JP 2001-219585 8/2001

* cited by examiner

*Primary Examiner*—Stephen D Meier
*Assistant Examiner*—Sarah Al-Hashimi
(74) *Attorney, Agent, or Firm*—Banner & Witcoff, LTD.

(57) ABSTRACT

An ink jet recording apparatus configured as a multi-function device is provided. The multi-function device can have four ink tanks, which store black ink, cyan ink, yellow ink and magenta ink. The multi-function device may have greater than four sub-tanks, which can be held in a scanning carriage and configured to move with a recording head. By moving the scanning carriage, the positions of the ink tanks can be aligned with the positions of the sub-tanks. In this manner, the basic inks can be supplied from the ink tanks into basic ink sub-tanks, and predetermined combinations of basic inks can be supplied into the other sub-tanks to create mixed inks.

16 Claims, 17 Drawing Sheets

| | |
|---|---|
| S1 | CARRIAGE IN PREDETERMINED POSITION? |
| S2 | POSITION CARRIAGE |
| S3 | OPERATE SLIDE CYLINDER |
| S4 | OPEN JOINT/VALVE |
| S5 | OPERATE PUMP |
| S6 | TRANSFER BASIC INK |
| S7 | MAKE MIXED COLOR INK? |
| S8 | TRANSFER ONE BASIC COLOR INK |
| S9 | MIX IN ANOTHER BASIC COLOR INK |
| S10 | MAKE ANOTHER MIXED COLOR INK? |

INK JET RECORDING APPARATUS

CROSS REFERENCE TO RELATED APPLICATIONS

This application claims priority from Japanese Patent Application No. 2005-081299, filed on Mar. 22, 2005, the subject matter of which is incorporated herein in its entirety by reference thereto.

FIELD

Aspects of the invention relate to an ink jet recording apparatus for performing image-recording by discharging ink droplets onto a recording medium.

BACKGROUND

In an ink jet recording apparatus, inks of different colors such as yellow, cyan, magenta and black are supplied to a recording head. The recording head discharges the different colors of ink to form dots on a recording medium, the dots forming a color image on the recording medium. One basic characteristic of an ink jet recording apparatus that is often of concern to a user is color reproducibility. Color reproducibility represents the magnitude of the difference between the color of the original and the color of the image formed on the recording medium generated from the original. The better the color reproducibility is, namely, the smaller the magnitude of the difference between the original and the image formed on the recording medium, the closer the color of an image formed by the ink jet recording apparatus will be to the color of the original.

If the number of different color inks discharged onto the recording medium is large (that is, if inks of many colors contribute to the image-recording), the color reproducibility of each color improves. Consequently, in some conventional ink jet recording apparatuses many ink cartridges are mounted and many inks are pre-stocked for example as shown in JP-A-2001-219585 and JP-A-6-293142.

In ink jet recording apparatuses in which many ink cartridges are mounted individually, an ink of every color has to be stocked irrespective of the frequency of use of the different colors. Consequently, the running cost of the ink jet recording apparatus increases. To avoid this problem, an ink jet printing apparatus has been proposed wherein inks of predetermined colors are prepared by mixing the colors in advance and then pouring the colors into ink cartridges as described in JP-A-6-293142. However, in an ink jet recording apparatus which employs such an ink preparation technique, the apparatus includes a separate device provided for mixing ink. As such, the ink jet recording apparatus becomes large and its manufacturing cost greatly increases.

SUMMARY

Aspects of the invention relate to an ink jet printing system that addresses one or more issues of the prior art, thereby providing an improved recording system.

DETAILED DESCRIPTION

Figure 1:
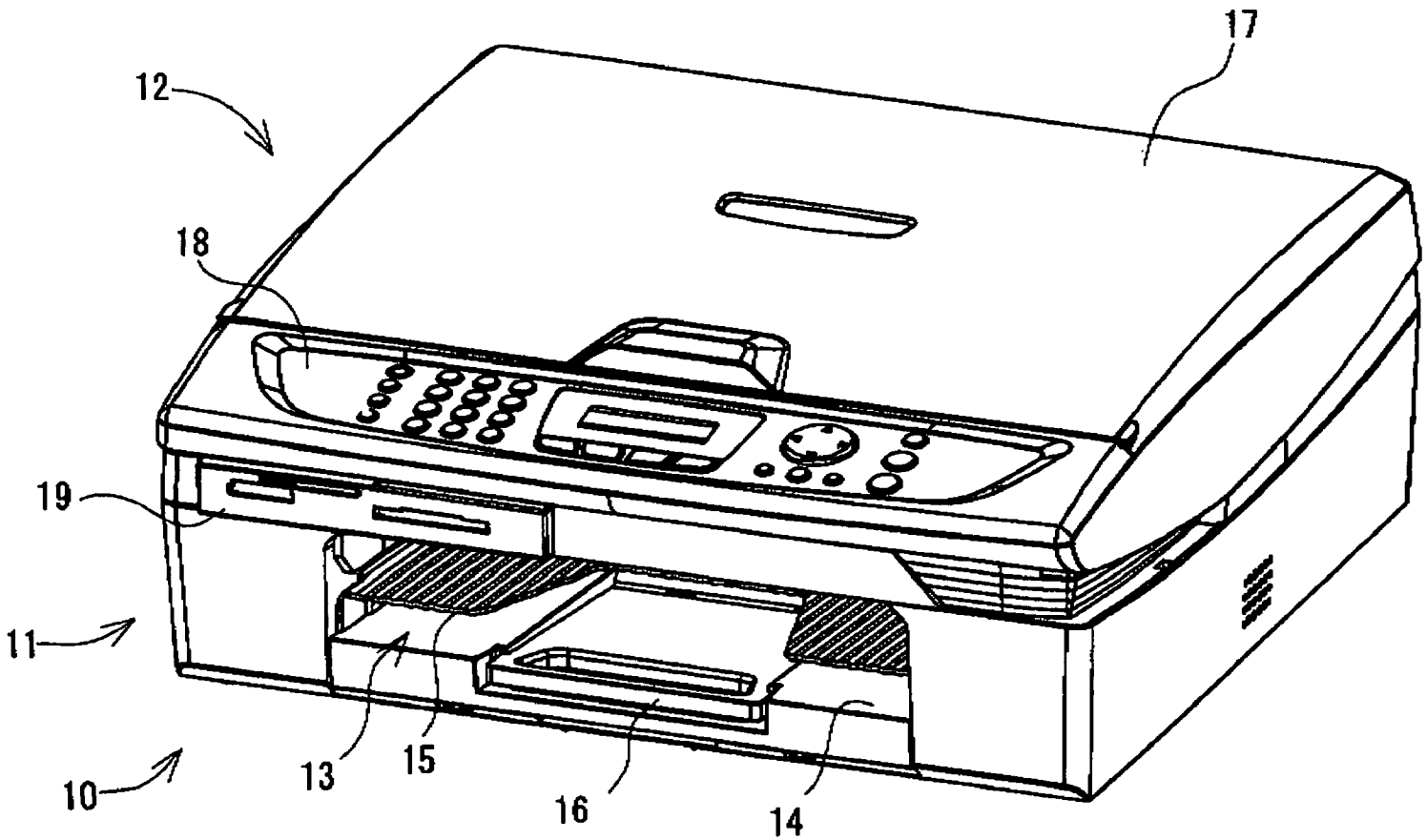
FIG. 1 is an external perspective view of an image-recording device according to at least one illustrative aspect of the invention.

It is noted that various connections are set forth between elements in the following description. It is noted that these connections in general and, unless specified otherwise, may be direct or indirect and that this specification is not intended to be limiting in this respect.

General Overview (1) An ink jet recording apparatus according to aspects of invention includes: n ink tanks for storing n basic inks; m (m>n) sub-tanks coupled to the ink tanks; supplying means for supplying the basic inks from the ink tanks to the sub-tanks; a carriage, movable in a scanning direction, for holding the sub-tanks and an inkjet recording head for discharging ink supplied to it from the sub-tanks onto a recording medium; and controller for controlling the supplying means and the carriage to supply a respective one of the basic inks to each of n sub-tanks among the m sub-tanks and supply a respective plurality of colors of basic ink to each of the other m-n sub-tanks among the m sub-tanks.

By the controller sliding the carriage, the n ink tanks are connected to n sub-tanks among the m sub-tanks. And by the controller operating the supplying means, the n colors (n types) of basic ink from the ink tanks are individually fed into the n sub-tanks. In this specification, these sub-tanks into which only the basic inks are supplied individually are defined as 'basic color ink sub-tanks'.

Similarly, by the controller sliding the carriage and operating the supplying means, a mixed ink made by mixing the basic inks is created in each of the (m-n) sub-tanks except for the n basic color sub-tanks. In this specification, these sub-tanks into which mixed inks are created are defined as 'mixed color sub-tanks'. Specifically, at first, by the controller sliding the carriage, a predetermined ink tank is connected to one of the mixed color sub-tanks. Then, by the controller operating the supplying means, a predetermined amount of the basic ink stored in the predetermined ink tank is fed into the sub-tank. Next, by the controller sliding the carriage, another ink tank is connected to the same mixed color sub-tank, and then by the controller operating the supplying means a predetermined amount of the basic ink stored in that ink tank is transferred into the mixed color sub-tank. Whereby, by basic inks from a plurality of ink tanks being supplied into one mixed color sub-tank, the plurality of basic inks are mixed inside the mixed color sub-tank and a predetermined mixed ink is created. Mixed inks are created in the other mixed color sub-tanks in the same way. That is, by a plurality of basic inks being supplied from a plurality of ink tanks to each of the m-n mixed color sub-tanks, m-n mixed inks are prepared.

From the sub-tanks, the m kinds of inks are supplied to an ink jet recording head. The carriage is moved in a scanning direction and a recording medium is carried in an auxiliary scanning direction (a direction perpendicular to the scanning direction). While the carriage is being moved the m inks are discharged onto the recording medium by the ink jet recording head, and an image is thereby formed on the recording medium.

(2) Preferably, the controller controls the supplying means and the carriage to supply the basic inks in order from lighter inks to darker inks when feeding the pluralities of basic inks.

(3) Preferably, the array pitch of the ink tanks is the same as the array pitch of the sub-tanks. With this configuration, when the carriage has been moved to a predetermined position and stopped, the ink tanks are all aligned with a corresponding sub-tank.

(4) Preferably, the arrangement of the colors in the n sub-tanks among the m sub-tanks is the same as the arrangement of the colors in the n ink tanks.

(5) Preferably, each of the ink tanks has a connecting portion to be connected to any of the sub-tanks and a valve provided to the connecting portion for preventing the basic ink stored in it from flowing to outside, and each of the sub-tanks has a valve-opening portion for opening the valve when the connecting portion is connected to it.

Illustrative Aspects

FIG. 1 is an external perspective view of a multi-function device 10 (ink jet recording apparatus) according to at least one aspect of the invention.

A multi-function device 10 can have integrally a printer portion 11 in a lower portion and a scanner portion 12 in an upper portion, and may have a printer function and a scanner function and a copier function. The printer portion 11 is an ink jet recording apparatus according to aspects of the invention. Aspects of the invention can also be applied to a single-function printer without a scanner function or a copier function, and can be applied to a unit having a facsimile function with a communication portion.

When used as an ink jet recording apparatus, the multi-function device 10 may be configured as a small unit or may be configured as a large unit having multiple paper-feed cassettes and automatic document feeders (ADF). Also, the multi-function device 10 may be configured to be connected to a computer (not shown) and to record images and text on a recording medium (e.g., paper) on the basis of image data and text data received from the computer. Also, the multi-function device 10 may be configured to be connected to a digital camera and record image data on the recording medium outputted from the digital camera. Alternatively, any of various recording media may be coupled to the multi-function device 10 and image data recorded on the recording media may be recorded onto recording medium (e.g., paper).

Although it will be discussed in more detail later, one feature of the multi-function device 10 according to at least one aspect can be that a small number of different inks, e.g., basic (unmixed) inks of a chosen color space, are pre-stored, and different ink combinations may be created from the basic inks. With different ink combinations being available in image formation, the color reproducibility of the multi-function device 10 can be improved. Furthermore, because the number of pre-stored basic inks is small, the running cost of the multi-function device 10 does not increase greatly.

As FIG. 1 shows, the multi-function device 10 may take on the rough external shape of a wide, low rectangular parallelpiped, and the width dimension and the front-rear depth direction of the multi-function device 10 can be set larger than the height dimension. The printer portion 11 is provided in a lower portion of the copier 10. The printer portion 11 can have an opening 13 in its front face. A paper feed tray 14 and a paper eject tray 15 can be provided at two levels one above the other so as to be exposed in this opening 13. The paper feed tray 14 is for storing paper and is capable of receiving paper of various sizes such as B5 size and postcard size up to and including A4 size. The paper feed tray 14 has a slide tray 16, and the slide tray 16 can be pulled out as necessary to present a larger tray face. The paper received on the paper feed tray 14 can be fed into the printer portion 11 and may have a predetermined image recorded thereon before being ejected onto the paper eject tray 15.

The scanner portion 12 is provided in an upper portion of the multi-function device 10. This scanner portion 12 is configured as a so-called flat bed scanner. The multi-function device 10 has a document cover 17. The document cover 17 is provided open/closably with respect to the multi-function device 10 and is configured as a roof plate of the multi-function device 10. A platen glass and an image-reading cartridge (not shown) are mounted on the lower side of the document cover 17. The platen glass is for setting a document on. The image-reading cartridge is mounted below this platen glass and is configured to slide in a scanning direction (the width direction of the multi-function device 10). The image-reading cartridge reads the document by sliding in the width direction of the multi-function device 10.

An operating panel 18 is provided on an upper portion of the front face of the multi-function device 10. This operating panel 18 is configured to receive user input for operating the printer portion 11 and the scanner portion 12. The operating panel 18 includes various operating buttons and a liquid crystal display. The multi-function device 10 operates in accordance with operating instructions input via operating panel 18 or in accordance with instructions received from a computer via a printer driver. A slot 19 is provided in an upper left portion of the front face of the multi-function device 10. Any of various removable media, i.e., recording media, can be loaded into this slot 19. Image data recorded on the removable media is displayed on the liquid crystal display. In response to user input to the operating panel 18, any image recorded on the removable media can be recorded on paper by the printer portion 11.

Figure 2:
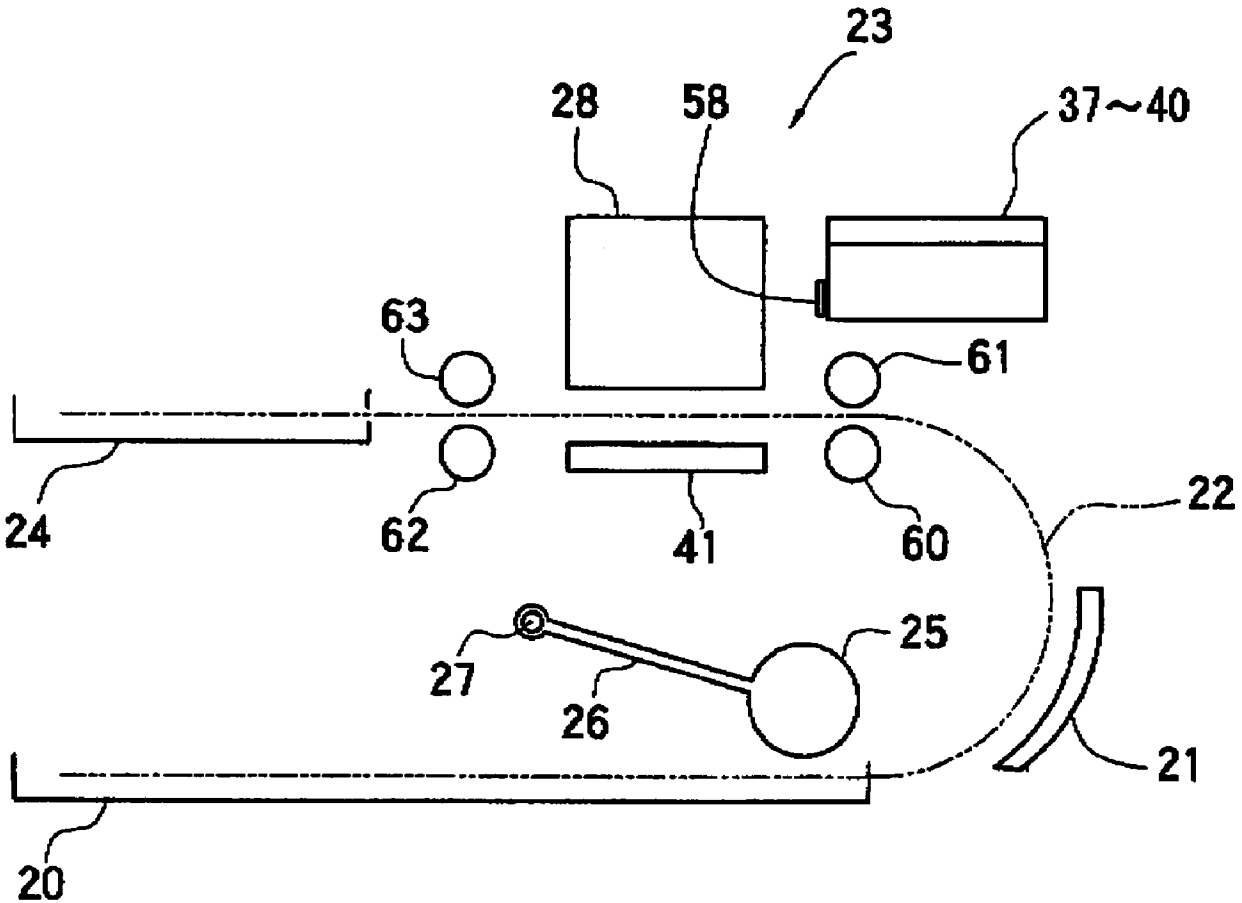
FIG. 2 is a schematic view showing the configuration of a printer portion of a multi-function device according to at least one illustrative aspect of the invention.

FIG. 2 is a schematic view showing the configuration of a printer portion 11 of the multi-function device 10. In this figure, the direction perpendicular to the paper is the width direction and the above-mentioned scanning direction of the multi-function device 10.

A paper feed tray 20 is provided at the bottom of the multi-function device 10. An inclined separating plate 21 for separating paper loaded on the paper feed tray 20 and guiding the paper upward is disposed on the rear side of the paper feed tray 20 (the right side in the figure). A feed path 22 is formed oriented upward from the inclined separating plate 21. After extending upward, the feed path 22 curves toward the front face side and extends from the back face side of the multi-function device 10 to the front face side. The feed path 22 passes through the image-recording portion 23 to the paper eject tray 24. Accordingly, the paper received in the paper feed tray 20 is guided by the feed path 22 so as to make a U-turn while moving upward to reach an image-recording portion 23. After the image-recording portion 23 has carried out image-recording on the paper, the paper is ejected onto a paper eject tray 24.

A paper feed roller 25 is mounted above the paper feed tray 20. The paper feed roller 25 separates paper loaded on the paper feed tray 20 one sheet at a time and feeds the sheet to the feed path 22. The configuration of the paper feed roller 25 is known, and for example the paper feed roller 25 is rotatably mounted on the distal end of an upward/downwardly pivoting paper feed arm 26 to move in and out of contact with the paper feed tray 20. The paper feed roller 25 is connected to a motor by way of a drive transmission mechanism (not shown). The drive transmission mechanism can be made up of a number of meshing gears. When the motor operates, a driving force is transmitted to cause the paper feed roller 25 to rotate.

The paper feed arm 26 is mounted pivotally about a base end shaft 27. As a result, the paper feed arm 26 can pivot about the base end shaft 27. In a standby state the paper feed arm 26 can be held in a raised position by a paper feed clutch and a spring (not shown). To feed paper the paper feed arm swings down to a lower position. When the paper feed arm 26 swings down to the lower position, the paper feed roller 25 mounted on the distal end of the paper feed arm makes pressing contact with the surface of the paper on the paper feed tray 20. In that state, the paper feed roller 25 rotates. A frictional force between the roller surface of the paper feed roller 25 and the paper feeds the uppermost sheet of paper to the inclined separating plate 21. The leading end of this paper contacts the inclined separating plate 21 and the paper is guided upward and fed into the feed path 22. As the uppermost sheet of paper is fed by the paper feed roller 25, sometimes the action of friction or static electricity causes a sheet of paper directly below the uppermost sheet to be fed out. However, the inclined separating plate 21 can prevent any additional sheet of paper fed with the uppermost sheet from continuing along the feed path 22 together with the uppermost sheet.

Parts of the feed path 22 other than where the image-recording portion 23 is disposed are formed by an outer guide surface and an inner guide surface that face each other with a predetermined spacing. In the multi-function device 10, the outer guide surface includes an inner wall surface of a frame of the multi-function device 10, and the inner guide surface includes the surface of a guide member mounted inside the frame of the multi-function device 10. Where the feed path 22 curves, carrying rollers may be provided. Although no carrying rollers are shown in FIG. 2, carrying rollers may be rotatably mounted with the width direction of the feed path 22 (the direction perpendicular to the paper in the figure) as the direction of the center axis of rotation of each. The carrying rollers are mounted so that their roller faces are exposed at the outer guide surface or the inner guide surface. With this configuration of the carrying rollers, the paper can be carried smoothly in contact with the guide surfaces even where the feed path 22 is curved.

Figure 3:
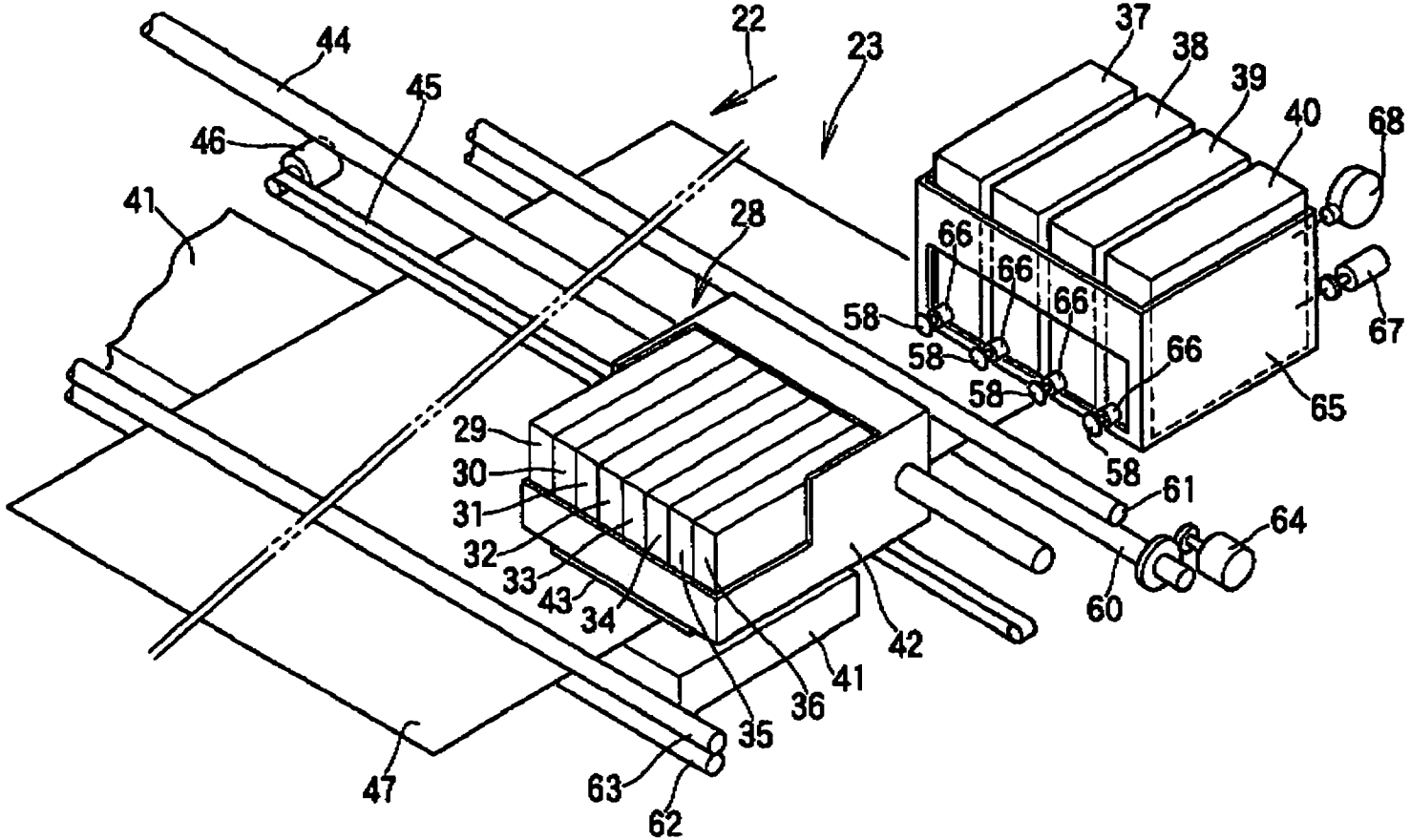
FIG. 3 is a perspective view showing schematically an image-recording portion of a multi-function device according to at least one illustrative aspect of the invention.

The image-recording portion 23 is mounted on the downstream side, after the feed path 22 has made an upward U-turn. FIG. 3 is a perspective view showing the configuration of the image-recording portion 23 schematically.

As shown in FIG. 2 and FIG. 3, the image-recording portion 23 has a head portion 28, a platen 41 disposed facing the head portion 28, sub-tanks 29 to 36 for supplying ink to a recording head 43 (ink jet recording head) which will be further discussed later, and cartridge-type ink tanks 37 to 40 for supplying ink to sub-tanks 29 to 36. The ink tanks 37 to 40 do not have to be of cartridge type, and can be any type of tanks that store ink. The image-recording portion 23 is for recording an image on a sheet of paper 47 which is carried over the platen 41. That is, an image is recorded on the paper 47 by the head portion 28 sliding in the scanning direction while discharging different colors of ink such as cyan (C), magenta (M), yellow (Y) and black (Bk) supplied from the ink tanks 37 to 40.

The head portion 28 has a scanning carriage 42. The sub-tanks 29 to 36 are held in this scanning carriage 42. The head portion 28 includes the above-mentioned recording head 43, which is held on the scanning carriage 42. The recording head 43 is disposed so as to be exposed on the underside of the scanning carriage 42, and ink is supplied to the recording head 43 from the sub-tanks 29 to 36. The scanning carriage 42 is supported on a guide shaft 44 and can be configured to slide along the guide shaft 44. An endless belt 45 is attached to the scanning carriage 42. A belt drive motor 46 is connected via a pulley to the endless belt 45, and when the belt drive motor 46 operates it slides the head portion 28 in the scanning direction.

Figure 4:
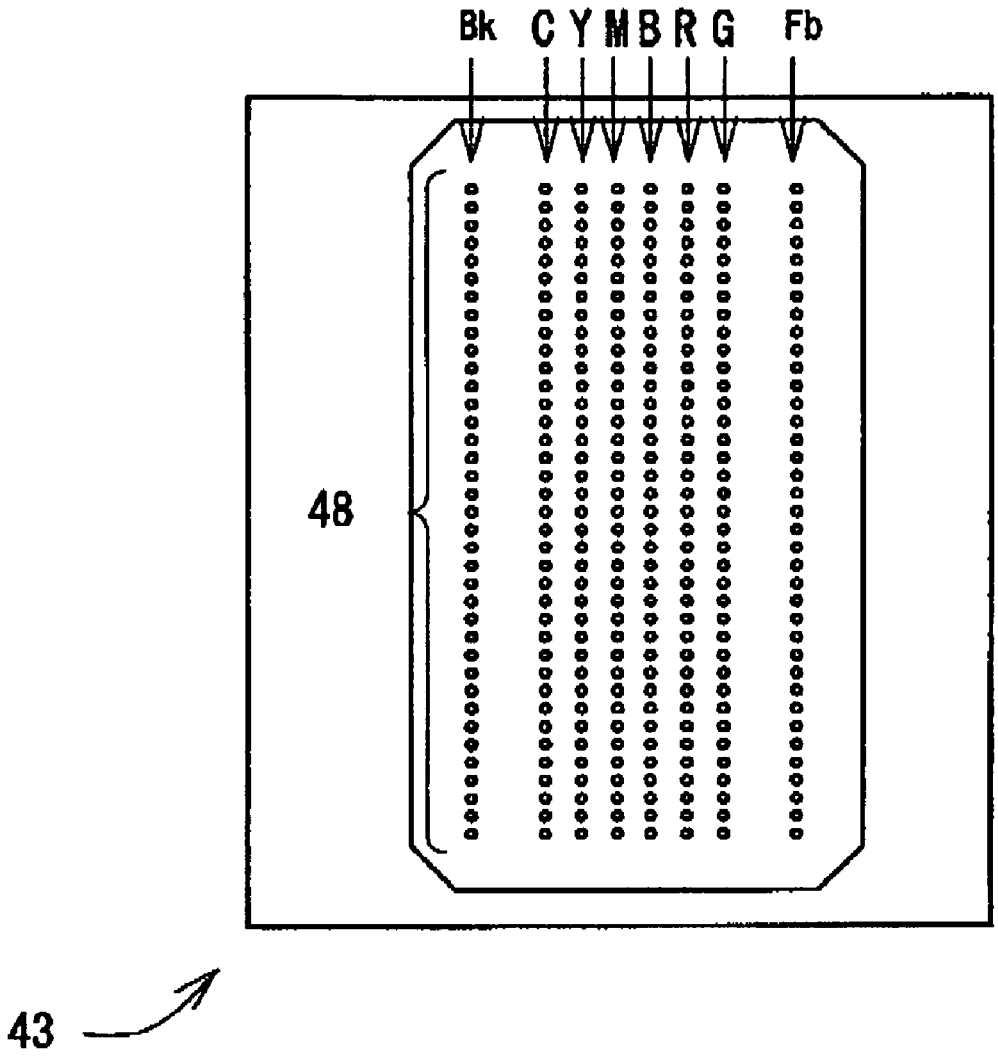
FIG. 4 is an enlarged bottom view of a recording head of a multi-function device according to at least one illustrative aspect of the invention.

FIG. 4 is an enlarged bottom view of the recording head 43, and shows the configuration of the underside of the recording head 43 in detail.

As shown in FIG. 4, ink discharge openings 48 are arrayed in vertical lines on the underside of the recording head 43. The vertical direction in FIG. 4 is the carrying direction of the paper 47. In this illustrative aspect, 8 rows of ink discharge openings 48 are provided. The ink discharge openings 48 positioned farthest to the left side in FIG. 4 correspond to black ink (Bk), which is discharged from these ink discharge openings 48. Adjacent to the ink discharge openings 48 for Bk ink, 7 additional rows of ink discharge openings 48 are provided. These rows of ink discharge openings 48 respectively correspond to cyan ink (C), yellow ink (Y), magenta ink (M), blue ink (B), red ink (R), green ink (G) and photo black ink (Fb). From these ink discharge openings 48 cyan ink (C ink), yellow ink (Y ink), magenta ink (M ink), blue ink (B ink), red ink (R ink), green ink (G ink) and photo black ink (Fb ink) can be discharged. That is, this recording head 43 can discharge 8 colors of ink.

Figure 5:
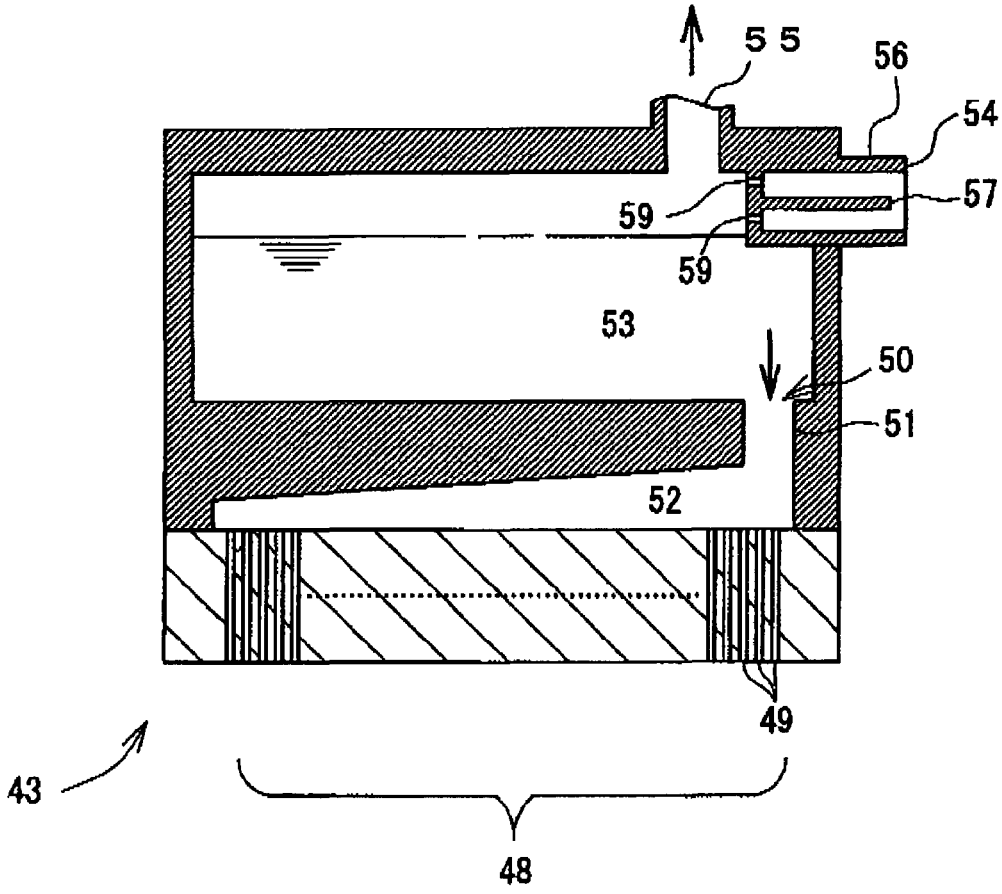
FIG. 5 is a sectional view of a head portion of a multi-function device according to at least one illustrative aspect of the invention.

FIG. 5 is a sectional view of the head portion 28.

As shown in FIG. 5, multiple nozzles 49 constituting the ink discharge openings 48 are lined up in the bottom of the recording head 43 for each of the colors of ink (Bk, C, Y, M, B, R, G, Fb). For the nozzles 49 corresponding to each color of ink, a manifold 50 is formed on the upstream side of the nozzles 49. The manifold 50 includes a supply pipe 51 formed at one end of the nozzles 49 and a manifold chamber 52 (ink chamber) formed continuously to the nozzles 49, and ink supplied through the supply pipe 51 is distributed to the nozzles 49 through the manifold chamber 52.

A face of the manifold chamber 52 opposite the nozzles 49 slopes in a downstream direction with respect to the direction in which the ink flows, and the cross-sectional area of the manifold chamber 52 gradually becomes smaller in the downstream direction. For discharging ink droplets through the ink discharge openings 48, any of various known mechanisms can be employed. For example, according to the above-described aspect a mechanism for propelling ink droplets by deforming a piezoelectric material is employed.

A buffer tank 53 is disposed above the manifold 50. A buffer tank 53 is provided for each color of ink, like the nozzles 49 and the manifold 50. These buffer tanks 53 may include the above-mentioned sub-tanks 29 to 36. Ink is supplied to the sub-tanks 29 to 36 from the ink tanks 37 to 40, which will be described in detail later, through ink supply openings 54. In this way, without ink being supplied from the ink tanks 37 to 40 to the nozzles 49 directly, by ink being temporarily stocked in the sub-tanks 29 to 36, air bubbles arising in the ink can be removed and air bubbles can be prevented from entering the manifold 50. Air bubbles caught in the sub-tanks 29 to 36 (buffer tanks 53) can be removed through air bubble exhaust openings 55.

The sub-tanks 29 to 36 (buffer tanks 53) corresponding to the colors of ink (Bk, C, Y, M, B, R, G, Fb) each have a mating portion 56. The above-mentioned ink supply opening 54 is provided at this mating portion 56. This mating portion 56 has a push rod 57 (valve-opening member). The push rod 57, as will be explained in detail later, opens a valve 58 (see FIG. 3) provided on each of the ink tanks 37 to 40. The push rod 57 is provided integrally with a side face of the mating portion 56 and extends toward the ink supply opening 54. A number of through holes 59 are provided in the side face of the mating portion 56, and ink fed from one of the ink tanks 37 to 40 passes through the through holes 59 and enters the sub-tank 29 to 36 (buffer tank 53).

The sub-tanks 29 to 36 (buffer tanks 53) are connected to the manifold chambers 52 through the supply pipes 51. Accordingly, colors of ink supplied from the ink tanks 37 to 40 flow through the sub-tanks 29 to 36 (buffer tanks 53) and the manifolds 50 to the nozzles 49. The recording head 43 discharges the colors of ink through the ink discharge openings 48 as ink droplets. The mechanism by which the colors of ink (Bk, C, Y, M, B, R, G, Fb) are supplied to the sub-tanks 29 to 36 will be explained in detail later.

As shown in FIG. 2 and FIG. 3, a drive roller 60 and a pressing roller 61 are provided on the upstream side of the image-recording portion 23. The drive roller 60 and the pressing roller 61 sandwich the paper 47 being carried along the feed path 22 and feed the paper 47 over the platen 41. Also, an eject roller 62 and a pressing roller 63 are provided on the downstream side of the image-recording portion 23. The eject roller 62 and the pressing roller 63 sandwich and feed the paper 47 having been recorded upon. The drive roller 60 is rotationally driven by a motor 64, and the eject roller 62 is also rotationally driven by a similar motor. In this manner the paper 47 is fed intermittently through a predetermined line width.

The pressing roller 61 is urged against the drive roller 60 so as to press the drive roller 60 with a predetermined pressing force. Accordingly, when the paper 47 comes between the drive roller 60 and the pressing roller 61, the pressing roller 61 retreats elastically by an amount corresponding to the thickness of the paper 47 as it cooperates with the drive roller 60 to sandwich the paper 47. Consequently, the rotational force of the drive roller 60 is transmitted to the paper 47. The pressing roller 63 is mounted in the same way with respect to the eject roller 62. However, because the pressing roller 61 presses upon a sheet of paper 47 that has been recorded upon, its roller face can be formed in a spur shape so that it does not degrade the recorded image.

The paper 47 sandwiched between the drive roller 60 and the pressing roller 61 is carried intermittently over the platen 41 through the predetermined line width. The recording head 43 can slide for every line of the paper 47, and performs image-recording from the leading end of the paper 47. The leading end of the paper 47 on which image-recording has been carried out is sandwiched between the eject roller 62 and the spur (pressing) roller 63. In other words, the paper 47 is carried intermittently through the predetermined line width with its leading end sandwiched between the eject roller 62 and the spur roller 63 and its trailing end sandwiched between the drive roller 60 and the pressing roller 61, and the recording head 43 records an image on the paper 47. As the paper 47 is carried further, the trailing end of the paper 47 emerges from between the drive roller 60 and the pressing roller 61. Consequently, the paper 47 is released from the drive roller 60 and the pressing roller 61 and is carried intermittently through the predetermined line width by the eject roller 62 and the spur roller 63. In this case also, the recording head 43 performs recording of an image onto the paper 47. After an image has been recorded in a predetermined area of the paper 47, the eject roller 62 is driven continuously and the paper 47 sandwiched between the eject roller 62 and the spur roller 63 is ejected onto the paper eject tray 24.

As shown in FIG. 3, the ink tanks 37 to 40 are held in a holder 65. The ink tanks 37 to 40 respectively hold Bk ink, C ink, Y ink, and M ink. Here, the Bk ink, C ink, Y ink, and M ink are defined as 'basic inks'. On a lower portion of each of the ink tanks 37 to 40, a connecting portion 66 configured to be connected to the mating portion 56 of one of the sub-tanks 29 to 36 is provided. This connecting portion 66 has a valve 58. The connecting portion 66 is continuous with the inside of the respective ink tank 37 to 40, and the valve 58 normally closes the connecting portion 66. When the valve 58 is pushed, the connecting portion 66 opens.

The ink tanks 37 to 40 each have a slide cylinder 67 and a pump 68. However, only the slide cylinder 67 and pump 68 corresponding to the ink tank 40 are shown in FIG. 3 for simplification. The slide cylinder 67 and the pump 68 are fixed to the holder 65. When the slide cylinder 67 extends, the respective ink tank 37 to 40 pushed by the slide cylinder 67 slides toward the head portion 28. At this time, if the position of the connecting portion 66 of the ink tank 37 to 40 and the position of the mating portion 56 of a sub-tank 29 to 36 coincide, ink is supplied from the ink tank 37 to 40 into the sub-tank 29 to 36. Because the belt drive motor 46 and the endless belt 45 causes the head portion 28 to slide, the positions of the connecting portions 66 of the ink tanks 37 to 40 and the positions of the mating portions 56 of the sub-tanks 29 to 36 can be made to coincide by the belt drive motor 46 being operated and the scanning carriage 42 sliding.

Here, the array pitch of the ink tanks 37 to 40 and the array pitch of the sub-tanks 29 to 36 can be the same. In that case, the pitch of the connecting portions 66 of the ink tanks 37 to 40 is the same as the pitch of the mating portions 56 of the sub-tanks 29 to 36. Accordingly, when the scanning carriage 42 has been made to slide and one of the connecting portions 66 of the ink tanks 37 to 40 has thereby been brought to face the mating portion 56 of one of the sub-tanks 29 to 36, all of the connecting portions 66 of the ink tanks 37 to 40 are disposed facing mating portions 56 of the corresponding sub-tanks 29 to 36. The effect of the pitch of the connecting portion 66 of the ink tanks 37 to 40 and the pitch of the mating portions 56 of the sub-tanks 29 to 36 being made the same will be further discussed later. However, it will be appreciated that the pitch of the connecting portions 66 of the ink tanks 37 to 40 and the pitch of the mating portions 56 of the sub-tanks 29 to 36 may alternatively be different.

By multiple basic inks being supplied to any one of the sub-tanks 30, 31, 33 and 35, a mixed ink can be created. In this aspect, as mentioned above, Bk ink is supplied to the sub-tank 29, C ink to the sub-tank 30, Y ink to the sub-tank 31, and M ink to the sub-tank 32. That is, the sub-tanks 29 to 32 hold basic inks and are called basic color sub-tanks. As shown in FIG. 3, in this aspect, the color arrangement of the basic color sub-tanks 29 to 32 is the same as the color arrangement of the ink tanks 37 to 40. The effect of this will be discussed later.

The sub-tanks 33 to 36, in order, hold B ink, R ink, G ink and Fb ink. The B ink is made by mixing C ink and M ink; the R ink is made by mixing Y ink and M ink; the G ink is made by mixing Y ink and C ink; and the Fb ink is made by mixing Y ink and M ink and C ink. That is, the B ink, the R ink, the G ink and the Fb ink are mixed inks made by mixing basic inks and the sub-tanks 33 to 36 are called mixed ink sub-tanks.

In FIG. 3, because the configurations of the holder 65 and the valves 58 are shown, the positional relationship between the holder 65 and the head portion 28 is different from that in the actual apparatus. That is, in reality, the head portion 28 and the holder 65 are close to each other, the positions of the sub-tanks 29 to 36 and the positions of the ink tanks 37 to 40 coincide, the mating portions 56 of the sub-tanks 29 to 36 and the connecting portions 66 of the ink tanks 37 to 40 are joined by the slide cylinders 67 operating, and basic ink is transferred from the ink tanks 37 to 40 to the sub-tanks 29 to 36 by the pumps 68 operating. Pumps 68 may be pressurizing pumps for pressurizing the ink tanks 37 to 40. However, the form of the pumps 68 is not limited to pressurizing pumps, and for example when the ink tanks 37 to 40 and the sub-tanks 29 to 36 are connected by tubes, rotary vane pumps may be employed.

Figure 6:
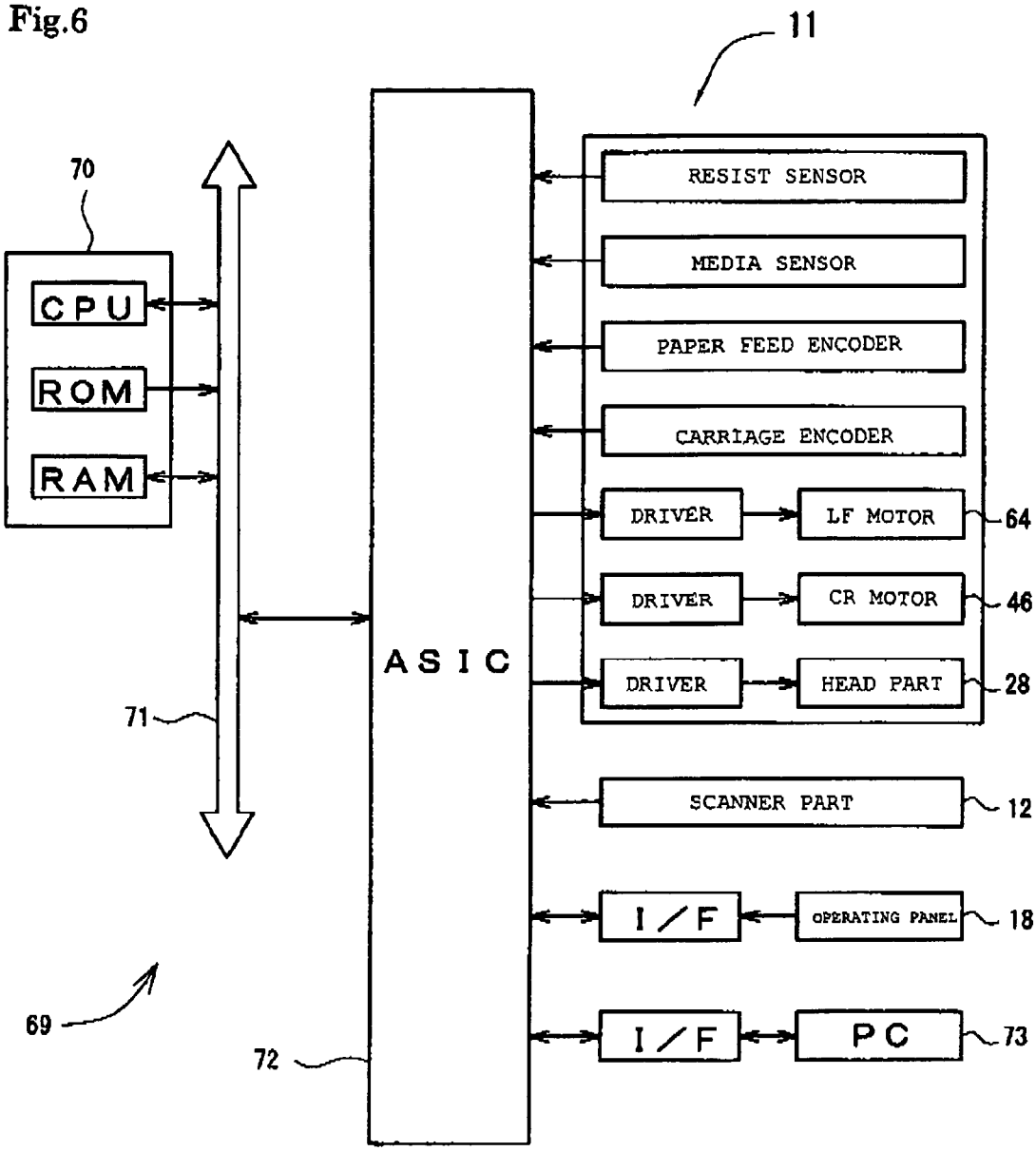
FIG. 6 is a block diagram showing a control unit of a multi-function device according to at least one illustrative aspect of the invention.

FIG. 6 is a block diagram showing the configuration of a control unit 69 of the multi-function device 10 according to at least one aspect of the invention.

As FIG. 6 shows, the control unit 69 has a central processing portion 70 having a CPU (Central Processing Unit), ROM (Read-Only Memory), and RAM (Random Access Memory), and this central processing portion 70 is connected to various sensors, the printer portion 11, the scanner portion 12 and the operating panel 18 and other components by a bus 71 and an ASIC (Application-Specific Integrated Circuit) 72.

The ROM of the central processing portion 70 stores a predetermined computer program. The CPU, in accordance with this computer program, performs computation on the basis of information from the various sensors. Besides rotation control of the motor 64 (LF motor) constituting the drive source of the drive roller 60 and rotation control of the belt drive motor 46 (CR motor) for sliding the head portion 28, extension control of the slide cylinders 67 for moving the ink tanks 37 to 40 toward the head portion 28 and control of the pumps 68 for feeding the basic ink in the ink tanks 37 to 40 into the sub-tanks 29 to 36 are carried out centrally by the CPU of the central processing portion 70.

The multi-function device 10 can be connected to, for example, a personal computer (PC) 73 and record images and text on the paper 47 on the basis of image data and text data received from computer 73. For this purpose it is also provided with an interface (I/F) for exchanging data with the computer 73. The configuration of the control unit 69 shown and described is just an example, and a control unit of any configuration that will perform the control described herein can be employed.

Figure 7:
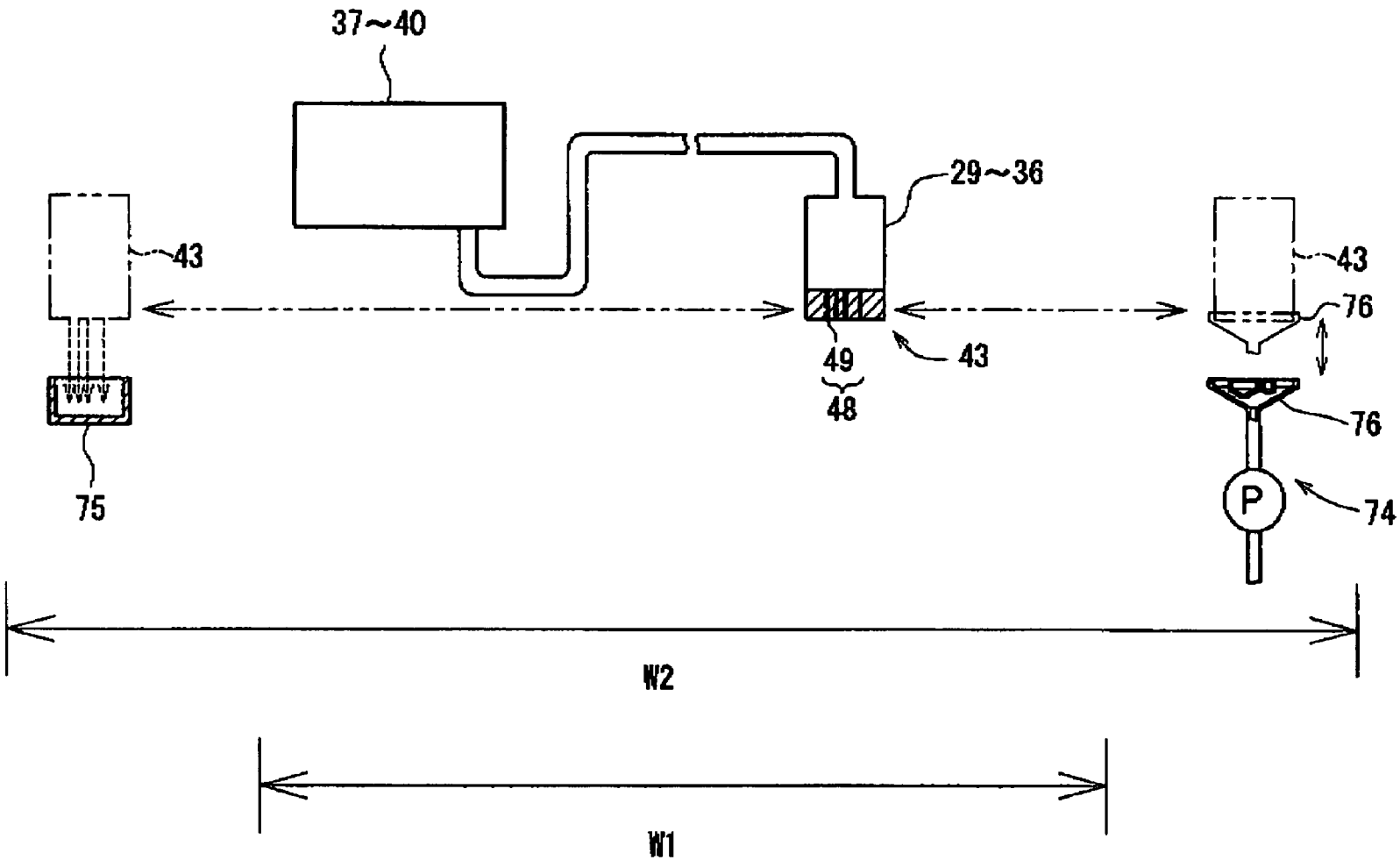
FIG. 7 is a view showing schematically an ink supply path and operating positions of a recording head in a multi-function device according to at least one illustrative aspect of the invention.

FIG. 7 shows schematically the supply path of ink from the ink tanks 37 to 40 to the recording head 43 via the sub-tanks 29 to 36 and the operating positions of the recording head 43.

Ink supplied from the ink tanks 37 to 40 is stored in the sub-tanks 29 to 36 (buffer tanks 53; see FIG. 5), where air bubbles in the ink can be captured as mentioned above. The ink flows through the supply pipe 51 into the manifold chamber 52 and is distributed among the nozzles 49 and discharged through the nozzles 49 as ink droplets. By the recording head 43 discharging ink droplets of the different colors of ink while sliding over an image recording range W1, an image is recorded on the paper 47 being carried below the recording head 43.

As shown in FIG. 7, a purge mechanism 74 and a waste ink tray 75 are disposed at opposite ends of a scannable range W2, outside the image-recording range W1 of the recording head 43. The purge mechanism 74 is for removing air bubbles and foreign matter from the nozzles 49 of the recording head 43 by suction. When the recording head 43 slides to the right end of the scannable range W2, a cap 76 of the purge mechanism 74 moves upward and the cap 76 makes contact with the underside of the recording head 43 so as to cover the ink discharge openings 48. A suction pump is connected to the cap 76 and sucks ink through the nozzles 49 of the recording head 43. Control of the belt drive motor 46 for sliding the recording head 43, movement control of the cap 76, and control of the suction pump are carried out by the control unit 69.

The waste ink tray 75 is for receiving preparatory discharge of ink from the recording head 43. This kind of preparatory discharge of ink is generally called flashing. At the time of flashing, the recording head 43 is moved to the left end of the scannable range W2, and in that position the different colors of ink are discharged into the waste ink tray 75. The left-right dispositions of the purge mechanism 74 and the waste ink tray 75 are not particularly limited, and alternatively they may be disposed left-right oppositely to that described above or may both be disposed on either the left or the right in the scannable range W2.

The holder 65 (see FIG. 3) holding the ink tanks 37 to 40 is installed at the right end of the scannable range W2. However, this holder 65 may alternatively be disposed at the left end of the scannable range W2. The basic inks (Bk ink, C ink, Y ink, M ink) stored in the ink tanks 37 to 40 are supplied to the sub-tanks 29 to 36 in the following way.

Figures 8A, 8B:
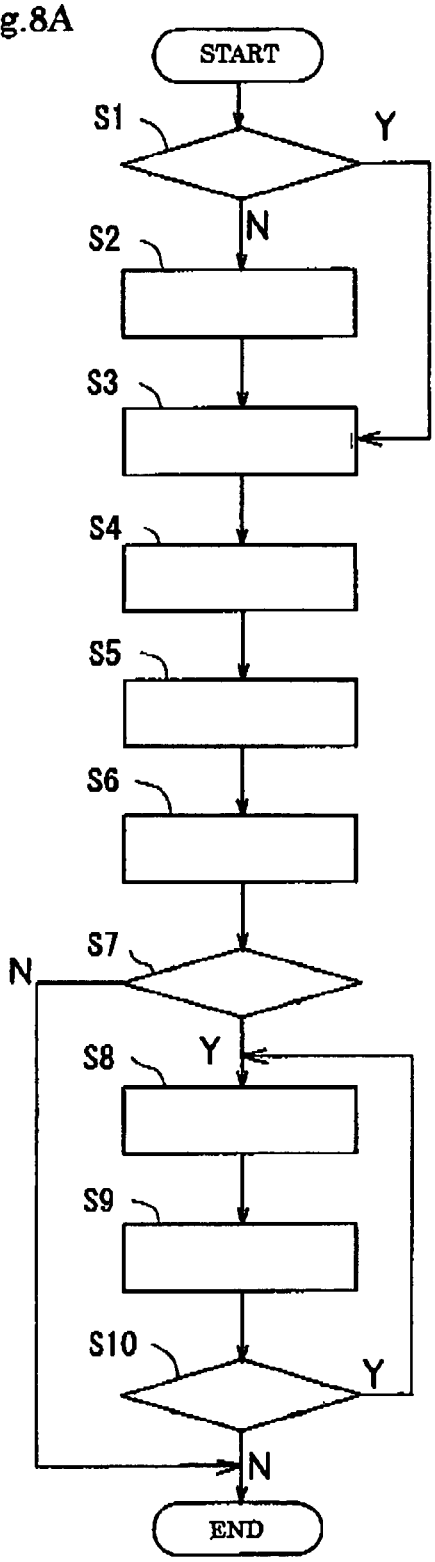
FIGS. 8A and 8B are flow charts showing how basic inks are supplied from ink tanks to sub-tanks in a multi-function device according to at least one illustrative aspect of the invention.

FIGS. 8A and 8B are flow charts showing how the basic inks are supplied from the ink tanks 37 to 40 to the sub-tanks 29 to 36 according to at least one aspect of the invention.

First, the basic inks are supplied from the ink tanks 37 to 40 to the basic color sub-tanks 29 to 32 among the sub-tanks 29 to 36. Specifically, it is determined whether the scanning carriage 42 of the head portion 28 is disposed in a predetermined position, namely at an end (for example the right end) of the scannable range W2 (step 1: S1). This determination can be made easily by, for example, providing a position sensor of the scanning carriage 42 such as an encoder.

When the scanning carriage 42 is not disposed in the predetermined position, the belt drive motor 46 is driven and the scanning carriage 42 is positioned in the predetermined position (step 2: S2). Then, the slide cylinders 67 are operated (step 3: S3) and the connecting portions 66 of the ink tanks 37 to 40 are fitted/connected to the mating portions 56 of the basic color sub-tanks 29 to 32. This opens the valves 58 of the connecting portions 66 (step 4: S4). Also, the pumps 68 are operated (step 5: S5), and the basic inks are fed individually into the respective basic color sub-tanks 29 to 32 (step 6: S6). This driving of the belt drive motor 46, operation of the slide cylinders 67 and operation of the pumps 68 and so on is controlled by the control unit 69. When the scanning carriage 42 is disposed in the predetermined position from the start, step 2 above can be omitted.

Next, it is determined whether the creation of a mixed ink is necessary (step 7: S7). This determination can be made easily by providing, for example, a sensor for detecting the ink level (ink surface height) in each of the sub-tanks 29 to 36. When a mixed ink is to be created (typically, when the level of a mixed ink in a sub-tank 33 to 36 has become low), the belt drive motor 46 is driven and the scanning carriage 42 is positioned in a predetermined position. The predetermined position in this example is the position such that a sub-tank among the sub-tanks 33 to 36 in which ink is to be mixed (for example the sub-tank 33) faces an ink tank holding a basic ink that needs to be supplied (for example the ink tank 38). Then the respective slide cylinder 67 is operated and the connecting portion 66 of the ink tank 37 to 40 (for example the ink tank 38) and the mating portion 56 of the sub-tank (for example the sub-tank 33) is fitted/connected together. This opens the valve 58 of the connecting portion 66. Also, the respective pump 68 is operated and one basic ink is fed from the ink tank 38 into the sub-tank 33 (step 8: S8).

Similarly again, the belt drive motor 46 is driven and the scanning carriage 42 is positioned in a predetermined position. The predetermined position in this example is the position such that the one of the sub-tanks among the sub-tanks 33 to 36 in which ink is to be mixed (for example the sub-tank 33) faces another ink tank holding a basic ink that needs to be supplied (for example the ink tank 39). The respective slide cylinder 67 is then operated and the connecting portion 66 of the ink tank 37 to 40 (for example the ink tank 39) and the mating portion 56 of the sub-tank (for example the sub-tank 33) is fitted/connected together. This opens the valve 58 of the connecting portion 66. The pump 68 is operated, and another basic ink is fed from the ink tank 39 into the sub-tank 33 (step 9: S9).

By step 8 and step 9 above, a mixed ink is created. Next, it is determined whether the creation of another mixed ink is necessary (step 10: S10). If the creation of another mixed ink is necessary, by the same procedure as that of step 8 and step 9 described above another mixed ink is created. If the creation of another mixed ink is not necessary, the ink-mixing process ends. In the creation of mixed inks also, the drive of the belt drive motor 46, the operation of the slide cylinders 67 and the operation of the pumps 68 are controlled by the control unit 69.

Figure 9:
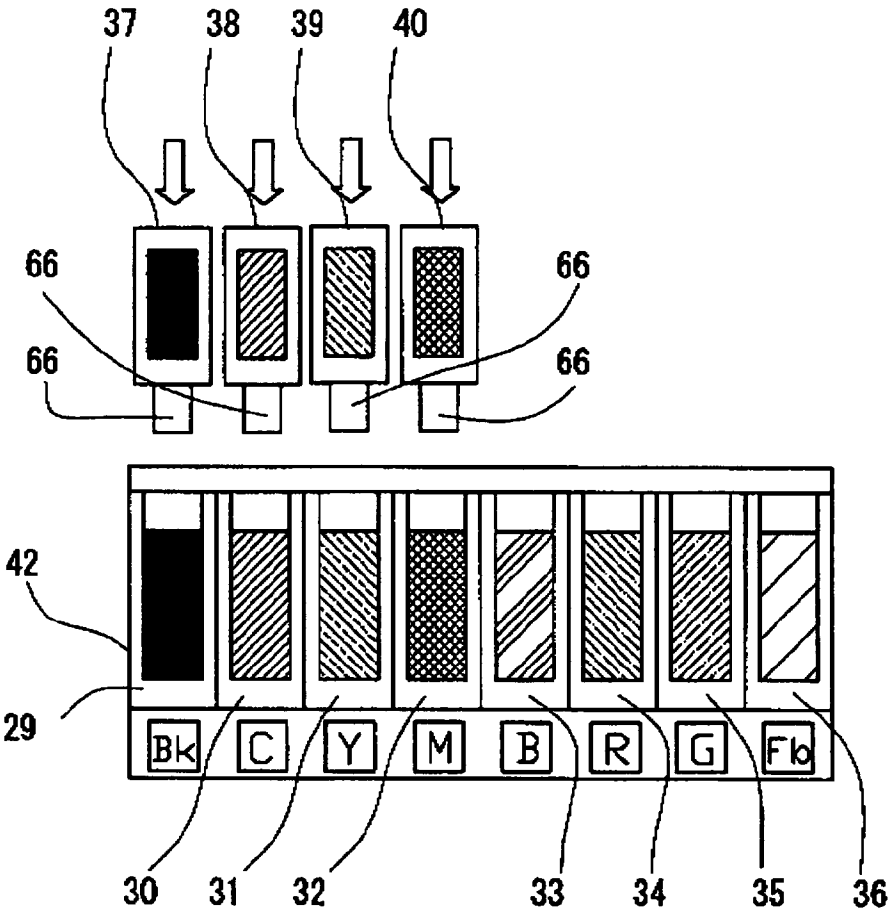
FIG. 9 is a view showing schematically how basic inks are transferred in a multi-function device according to at least one illustrative aspect of the invention.

FIG. 9 is a schematic view showing in detail how the basic inks (Bk ink, C ink, Y ink, M ink) are supplied from the ink tanks 37 to 40 to the basic color sub-tanks 29 to 32. How the basic inks are fed into the basic color sub-tanks 29 to 32 is shown specifically below.

In accordance with step 2 to step 6 (see FIG. 9), the scanning carriage 42 is positioned and the ink tanks 37 to 40 are connected to the basic color sub-tanks 29 to 32. At this time, the connecting portions 66 of the ink tanks 37 to 40 are fitted in the mating portions 56 of the sub-tanks 29 to 32, and the basic inks are fed into the sub-tanks 29 to 32 by the pumps 68. In this aspect, the sub-tanks 29 to 32 correspond to Bk ink, C ink, Y ink and M ink. That is, the arrangement of the sub-tanks 29 to 32 and the arrangement of the ink tanks 37 to 40 are the same. However, the arrangement of the basic color sub-tanks 29 to 32 and the arrangement of the ink tanks 37 to 40 do not have to be the same.

Figure 10:
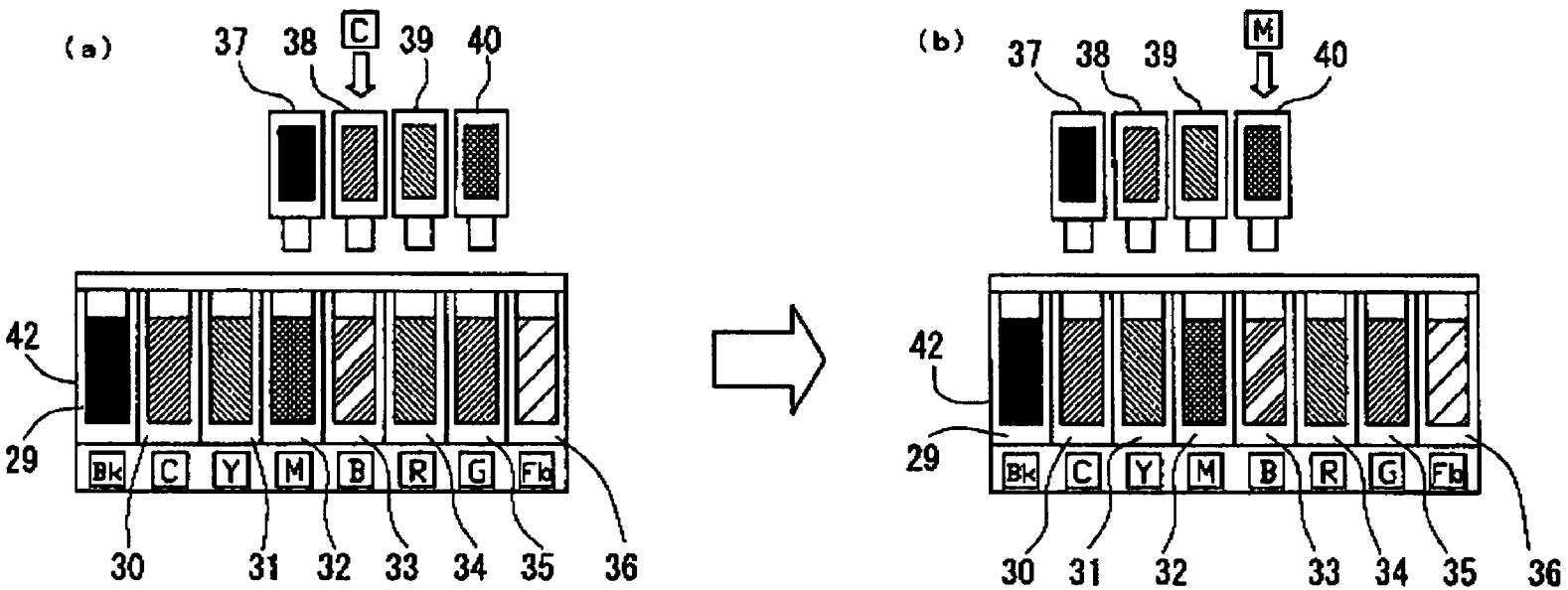
FIGS. 10*a* and 10*b* are schematic views showing how B ink is prepared in a multi-function device according to at least one illustrative aspect of the invention.

Next, a mixed ink (B ink) is created in the sub-tank 33. FIGS. 10A and 10B are schematic views showing the creation of B ink.

B ink is created by mixing the basic inks C ink and M ink. First, as shown in FIG. 10A, the scanning carriage 42 is made to slide and the ink tank 38 is connected to the sub-tank 33. The sub-tank 33 is a mixed color sub-tank allotted to having a mixed ink (B ink) prepared therein. At this time, the connecting portion 66 of the ink tank 38 is mated with the mating portion 56 of the sub-tank 33, and C ink is fed into the sub-tank 33 by the respective pump 68. Next, as shown in FIG. 10B, the scanning carriage 42 is made to slide and the ink tank 40 is connected to the sub-tank 33. The connecting portion 66 of the ink tank 40 is mated with the mating portion 56 of the sub-tank 33, and M ink is fed into the sub-tank 33 by the respective pump 68. By this mechanism, B ink is created in the sub-tank 33. In the creation of B ink, alternatively the M ink may be fed into the sub-tank 33 first and then the C ink supplied afterward. That is, of the basic inks to be mixed, the inks may be fed into the sub-tank 33 in order from the ink with the palest color. The effect of this will be discussed later.

Figure 11:
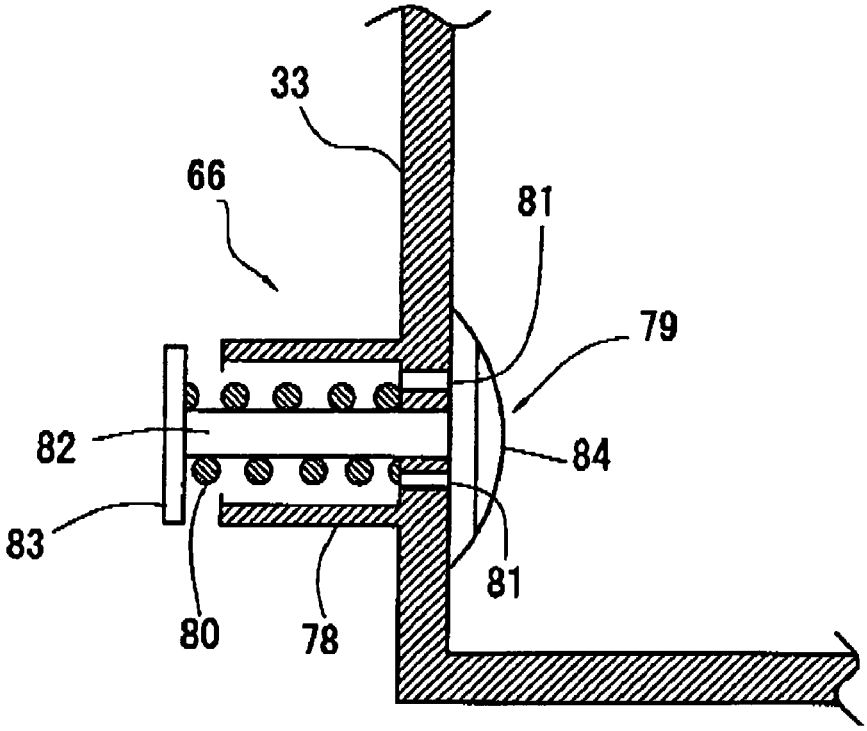
FIG. 11 is a sectional view of a connecting portion of an ink tank in a multi-function device according to at least one illustrative aspect of the invention.

FIG. 11 is a sectional view of the connecting portion 66 of the ink tank 38, in which the configuration of the valve 58 is shown.

As FIG. 11 shows, the connecting portion 66 has an outer cylinder 78, a valve member 79 and a coil spring 80. The outer cylinder 78 projects outward from the wall face of the ink tank 38. The outer cylinder 78 and the ink tank 38 are connected by multiple small holes 81. The valve member 79 has a main shaft 82 passing through from inside the outer cylinder 78 to inside the ink tank 38, a flange 83 provided on one end of the main shaft 82, and a head portion 84 provided on the other end of the main shaft 82 and disposed inside the ink tank 38. The main shaft 82 is slidably supported by the wall of the ink tank 38 and is advance/retractable with respect to the ink tank 38. The flange 83 is formed integrally with the main shaft 82 and its external diameter dimension is set to be equal to or greater than the external diameter dimension of the outer cylinder 78. Accordingly, when the main shaft 82 slides to the right side in the figure, the flange 83 abuts with the end face of the outer cylinder 78. The head portion 84 can close the small holes in a water tight manner by abutting with the wall face of the ink tank 38. The coil spring 80 is disposed on the inner side of the outer cylinder 78, and the main shaft 82 passes through the inside of the coil spring 80.

Thus, normally, the flange 83 is urged elastically by the coil spring 80 toward the left side in FIG. 11, and under this elastic force the head portion 84 abuts with the wall face of the ink tank 38. That is, ink does not leak out from the ink tank 38. However, when this connecting portion 66 is fitted in the mating portion 56 of the sub-tank 33, the push rod 57 of the mating portion 56 pushes the flange 83. Consequently, the head portion 84 moves away from the wall face of the ink tank 38 and it becomes possible for ink in the ink tank 38 to be fed into the sub-tank 33. If the pump 68 is operated, ink is fed into the sub-tank 33. The configuration of the connecting portion 66 is also the same for the other ink tanks.

Figure 12:
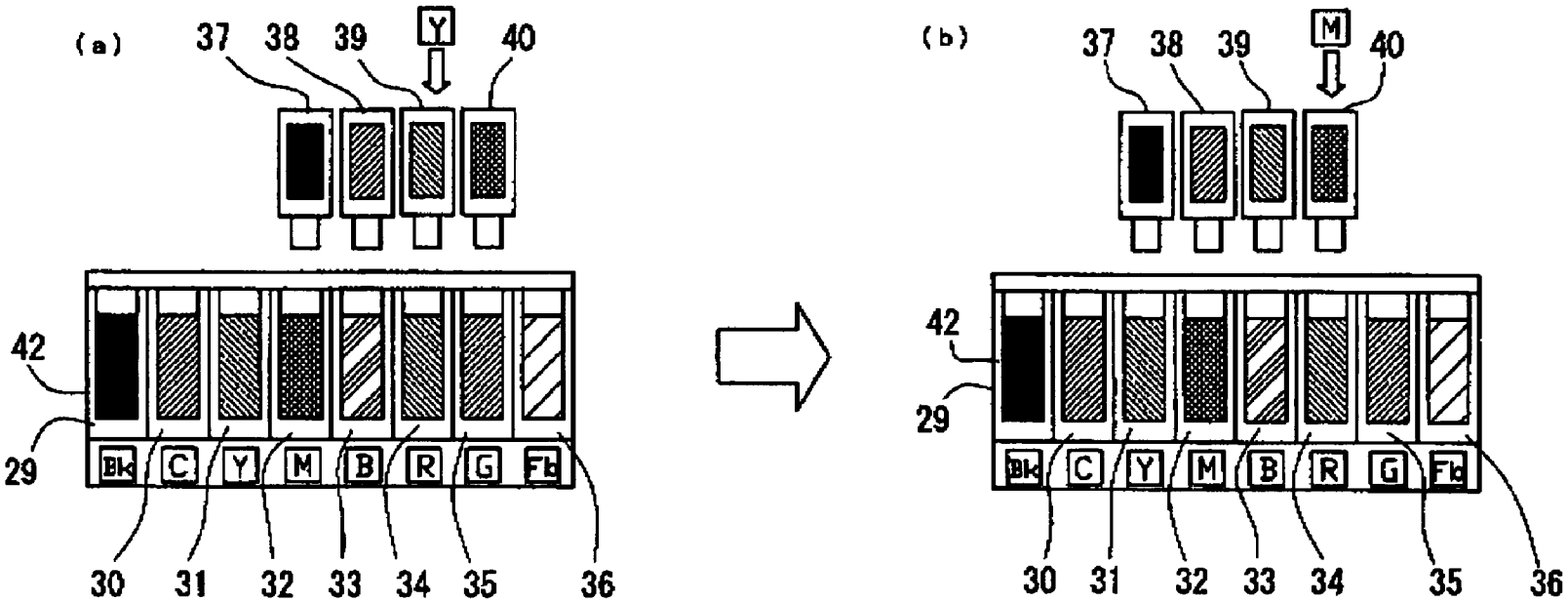
FIGS. 12A and 12B are schematic views showing how R ink is prepared in a multi-function device according to at least one illustrative aspect of the invention.

Next, a mixed ink (R ink) is created in the sub-tank 34. FIGS. 12A and 12B are schematic views showing the creation of R ink according to at least one aspect of the invention.

R ink is created by mixing the basic inks Y ink and M ink. First, as shown in FIG. 12A, the scanning carriage 42 is made to slide and the ink tank 39 is connected to the sub-tank 34. This sub-tank 34 is a mixed color sub-tank allotted to have a mixed ink (R ink) prepared therein. At this time, the connecting portion 66 of the ink tank 39 is mated with the mating portion 56 of the sub-tank 34 and Y ink is fed into the sub-tank 34 by the pump 68. Next, as shown in FIG. 12B, the scanning carriage 42 is made to slide and the ink tank 40 is connected to the sub-tank 34. The connecting portion 66 of the ink tank 40 is mated with the mating portion 56 of the sub-tank 34, and M ink is fed into the sub-tank 34 by the pump 68 and R ink is created in the sub-tank 34. In the creation of R ink, the Y ink can be fed into the sub-tank 34 first and the M ink can be supplied afterward. That is, of the basic inks to be mixed, the inks can be fed into the sub-tank 34 in order from the ink with the palest color. However, alternatively the M ink may be fed into the sub-tank 34 first. The effect of feeding the Y ink into the sub-tank 34 first will be discussed later.

Figure 13:
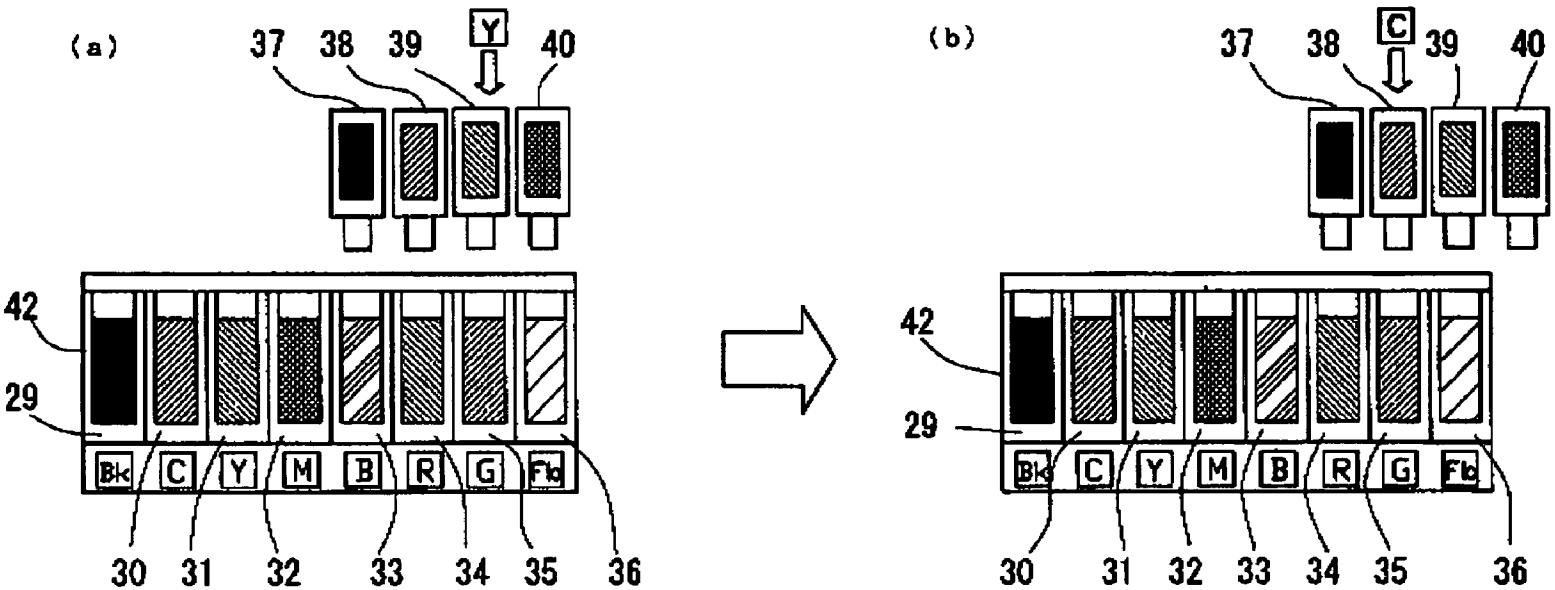
FIGS. 13A and 13B are schematic views showing how G ink is prepared in a multi-function device according to at least one illustrative aspect of the invention.

Next, a mixed ink (G ink) is created in the sub-tank 35. FIGS. 13A and 13B are schematic views showing the creation of G ink according to at least one aspect of the invention.

G ink is made by mixing the basic inks Y ink and C ink. First, as shown in FIG. 13A, the scanning carriage 42 is made to slide and the ink tank 39 is connected to the sub-tank 35. The sub-tank 35 is a mixed color sub-tank allotted to have a mixed ink (G ink) prepared therein. At this time, the connecting portion 66 of the ink tank 39 is mated with the mating portion 56 of the sub-tank 35 and Y ink is fed into the sub-tank 35 by the pump 68. Next, as shown in FIG. 13B, the scanning carriage 42 is made to slide, and the ink tank 38 is connected to the sub-tank 35. The connecting portion 66 of the ink tank 38 is mated with the mating portion 56 of the sub-tank 35 and C ink is fed into the sub-tank 35 by the pump 68 and G ink is created in the sub-tank 35. In the creation of G ink, the Y ink to be fed into the sub-tank 35 first and the C ink to be supplied afterward. That is, of the basic inks to be mixed, inks can be fed into the sub-tank 35 in order from the ink with the palest color. However, alternatively the C ink may be fed into the sub-tank 35 first. The effect of feeding the Y ink into the sub-tank 35 first will be discussed later.

Figure 14:
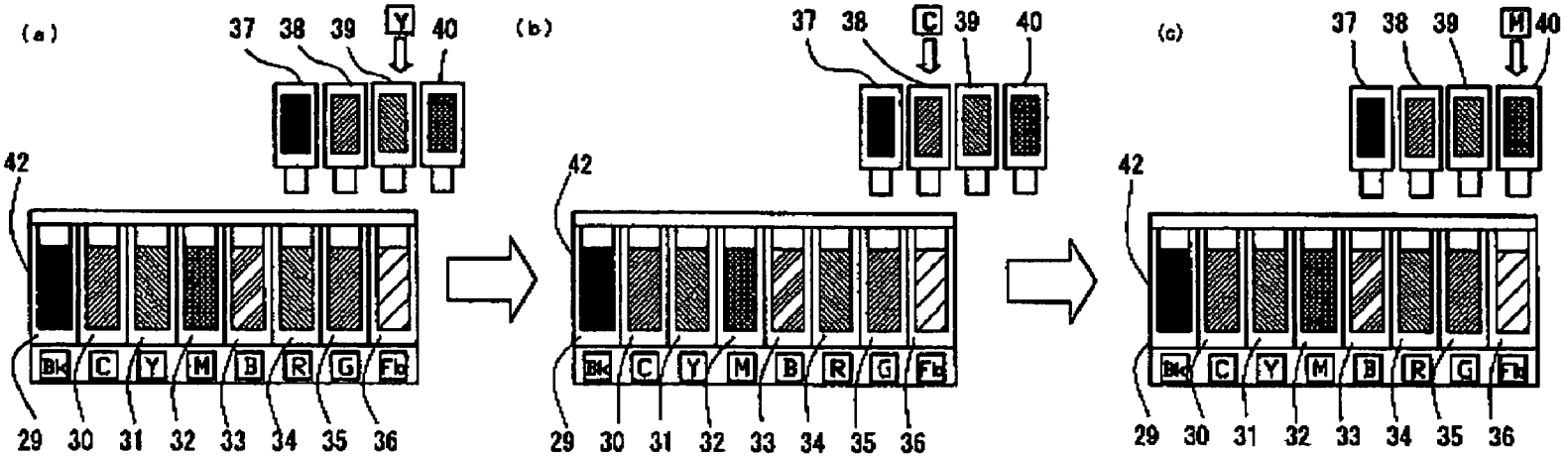
FIGS. 14A to 14C are schematic views showing how Fb ink is prepared in a multi-function device according to at least one illustrative aspect of the invention.

Next, a mixed ink (Fb ink) is created in the sub-tank 36. FIGS. 14A to 14C are schematic views showing the creation of Fb ink according to at least one aspect of the invention.

Fb ink is made by mixing the basic inks Y ink and C ink and M ink. First, as shown in FIG. 14A, the scanning carriage 42 is made to slide and the ink tank 39 is connected to the sub-tank 36. The sub-tank 36 is a mixed color sub-tank allotted to have a mixed ink (Fb ink) prepared in it. At this time, the connecting portion 66 of the ink tank 39 is mated with the mating portion 56 of the sub-tank 36 and Y ink is fed into the sub-tank 36 by the pump 68. Next, as shown in FIG. 14B, the scanning carriage 42 is made to slide, and the ink tank 38 is connected to the sub-tank 36. The connecting portion 66 of the ink tank 38 is mated with the mating portion 56 of the sub-tank 36, and C ink is fed into the sub-tank 36 by the pump 68. Next, as shown in FIG. 14C, the scanning carriage 42 is made to slide, and the ink tank 40 is connected to the sub-tank 36. The connecting portion 66 of the ink tank 40 is mated with the mating portion 56 of the sub-tank 36 and M ink is fed into the sub-tank 36 by the pump 68 and Fb ink is created in the sub-tank 36. In the creation of Fb ink, alternatively the inks may be fed into the sub-tank 36 in the order of Y ink, M ink, C ink. That is, of the basic inks to be mixed, inks can be supplied into the sub-tank 36 in order from the ink with the palest color. The effect of this will be discussed later.

In this way, basic inks are fed into the sub-tanks 29 to 36 from the ink tanks 37 to 40, and from the ink tanks 37 to 40 storing four different basic inks, eight different inks can be created and stocked in the sub-tanks 29 to 36. Although according to at least one aspect the basic inks are the four inks Bk ink, C ink, Y ink and M ink, there is no limit to the varieties of basic ink, and more generally n different basic inks may be stored in the ink tanks. In this case, because still more mixed inks are made by mixing the n different basic inks, it becomes possible to stock m (m>n) different inks in the sub-tanks.

The multi-function device 10 may be constructed to perform head cleaning of the recording head 43 by the above-mentioned ink suction operation and preparatory discharge operation, with the sub-tanks 29 to 36 filled with ink. This head cleaning operation can be carried out by a computer program stored in the ROM (see FIG. 6) of the control unit 69.

Thus, with the multi-function device 10 of this embodiment, just by four ink tanks 37 to 40 being provided, eight different inks are prepared, which is more than the number of ink tanks 37 to 40, and stocked in sub-tanks 29 to 36. These sub-tanks 29 to 36 are held in a scanning carriage 42 together with a recording head 43, and by this scanning carriage 42 being made to slide, the four ink tanks 37 to 40 are connected with four basic color sub-tanks 29 to 32 among eight sub-tanks 29 to 36. By pumps 68 operating, four basic inks are individually fed into the basic color sub-tanks 29 to 32 from the ink tanks 37 to 40. Similarly, by the scanning carriage 42 being made to slide and the pumps 68 operating, basic inks selected as described above can be fed into each of four mixed color sub-tanks, and the basic inks are thereby mixed to create mixed inks.

In other words, by the scanning carriage 42 being made to slide and pumps 68 being operated, predetermined amounts of C ink and M ink are fed into the sub-tank 33 and B ink is thereby made. Similarly, predetermined amounts of Y ink and M ink are fed into the sub-tank 34 and R ink is thereby made. Predetermined amounts of Y ink and C ink are fed into the sub-tank 35 and G ink is thereby made and predetermined amounts of Y ink, C ink and M ink are fed into the sub-tank 36 and Fb ink is thereby made. That is, four mixed inks are created from the four basic inks, and in total eight inks can be simply stocked in the sub-tanks 29 to 36.

As shown in FIG. 3, the scanning carriage 42 is made to slide in a scanning direction, and paper 47 is carried in an auxiliary scanning direction (a direction perpendicular to the scanning direction). By the recording head 43 suitably discharging the eight inks onto the paper 47 while the scanning carriage 42 is made to slide, an image is formed on the paper 47.

At this time, because the four mixed inks contribute to image formation in addition to the four basic inks, the color reproducibility of the multi-function device 10 can be improved. Furthermore, the mixed inks are not made in a separately provided mixing device or the like, and are created by basic inks being mixed in the sub-tanks 33 to 36 by the scanning carriage 42 being made to slide. Therefore, mixed inks corresponding to color characteristics of an image to be recorded can be prepared simply and cheaply. As a result even in the case of a multi-function device 10 in which multiple inks are used, its running cost does not increase greatly.

In a multi-function device 10 according to this aspect, when a mixed ink is prepared, i.e. when basic inks are mixed, the basic ink with the palest color can be fed in first and then basic inks supplied thereafter in their order of increasing darkness of color. In this case, when the ink tanks 37 to 40 are connected to the sub-tanks 33 to 36, even if an ink from a sub-tank 33 to 36 side gets into an ink tank 37 to 40, because the ink stored in the ink tank 37 to 40 is the darker in color, the adverse effect of color mixing to the ink tanks 37 to 40 is small.

In particular, when the array pitch of the ink tanks 37 to 40 and the array pitch of the sub-tanks 29 to 36 are set to be the same, by the scanning carriage 42 being made to slide, the connecting portions 66 of the ink tanks 37 to 40 come to face the mating portions 56 of corresponding sub-tanks 29 to 36. Accordingly, ink can be fed into the sub-tanks 29 to 36 from the ink tanks 37 to 40 serially, or all the basic inks can be fed from the ink tanks 37 to 40 into the sub-tanks 29 to 36 simultaneously. That is, inks can be fed from the ink tanks 37 to 40 into the sub-tanks 29 to 36 quickly.

Moreover, according to at least one illustrative aspect, the color arrangement of the ink tanks 37 to 40 in which the four basic inks are stored and the color arrangement of the basic color sub-tanks 29 to 32 are the same. In this way, the four basic inks can be fed into the basic color sub-tanks 29 to 32 simultaneously. Accordingly, supplying of the basic inks into the basic color sub-tanks 29 to 32 can be carried out quickly, and as a result the time taken to supply the total of eight inks into the basic color sub-tanks 29 to 32 can be shortened. Although according to this aspect, four basic inks are provided, more generally n basic inks may be provided, as mentioned above, and in this case generally m (m>n) inks can be supplied into the sub-tanks in a shortened time.

Also, according to at least one aspect, each of the ink tanks 37 to 40 has a valve 58, and this valve 58 is opened by a push rod 57 provided on each of the sub-tanks 29 to 36. Therefore the leakage of ink from the ink tanks 37 to 40 can be prevented at all times, and also, when ink is being supplied from the ink tanks 37 to 40 to the sub-tanks 29 to 36, the supply of ink can be carried out extremely simply.

In at least one aspect, pumps 68 provided on the ink tanks 37 to 40 supply inks from the ink tanks 37 to 40 to the sub-tanks 29 to 36. However, the ink supplying means does not have to be pumps 68, and various other alternatives can be employed. For example, the ink tanks 37 to 40 may each be provided with an electro-straining device, or so-called 'artificial muscle'. In this case, as a result of a voltage being applied to this electro-straining device a strain arises in the electro-straining device, and the ink tanks 37 to 40 are pressurized and ink is discharged from the ink tanks 37 to 40. Accordingly, ink can be supplied from the ink tanks 37 to 40 to the sub-tanks 29 to 36 with the ink tanks 37 to 40 and the sub-tanks 29 to 36 not in contact. As a result, the problem of other colors mixing with the basic inks stored in the ink tanks 37 to 40 can be avoided. Because the strain of the electro-straining device is proportional to the voltage, the amount of ink supplied from the ink tanks 37 to 40 to the sub-tanks 29 to 36 can be controlled in correspondence with the number of strainings of the electro-straining device.

As described above, according to aspects of the invention, the color arrangement of the ink tanks 37 to 40 in which the four basic inks are stored and the color arrangement of the basic color sub-tanks 29 to 32 are the same (see FIG. 9). At this time, as shown in FIG. 9, the arrangement of the ink tanks 37 to 40 can be, in order from the left in the figure, Bk ink, C ink, Y ink and M ink, and the color arrangement of the basic color sub-tanks 29 to 32 is the same as this. However, the relationship between the color arrangement of the ink tanks 37 to 40 and the color arrangement of the sub-tanks 29 to 36 does not have to be as shown in FIG. 9, and may alternatively be any of the arrangements shown in FIG. 15 through FIG. 17.

Figure 15:
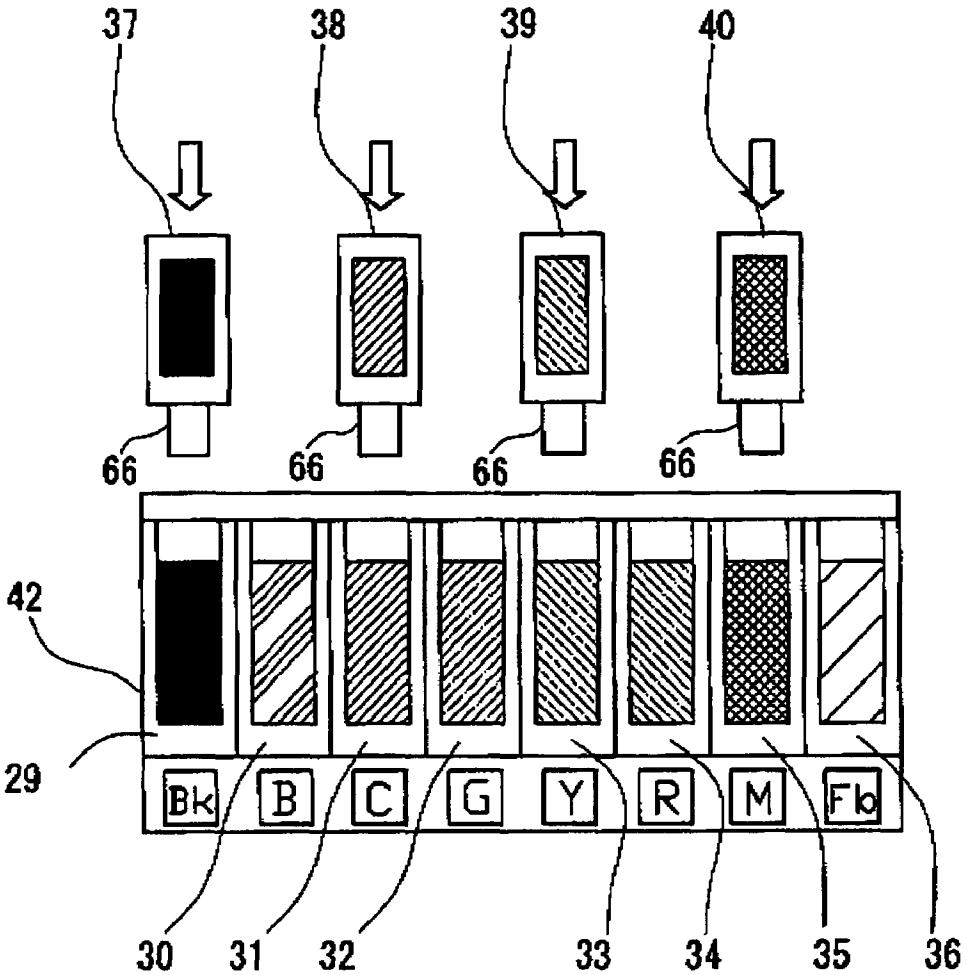
FIG. 15 is a view showing the color arrangements of ink tanks and sub-tanks according to certain illustrative aspects of the invention.

In FIG. 15, the color arrangement of the sub-tanks 29 to 36 is, in order from the left in the figure, Bk ink, B ink, C ink, G ink, Y ink, R ink, M ink and Fb ink. The color arrangement of the ink tanks 37 to 40 is, in order from the left in FIG. 15, Bk ink, C ink, Y ink and M ink, and the ink tanks 37 to 40 are disposed facing the corresponding inks in the sub-tanks 29 to 32. That is, the array pitch of the ink tanks 37 to 40 is twice the array pitch of the sub-tanks 29 to 36.

Figure 16:
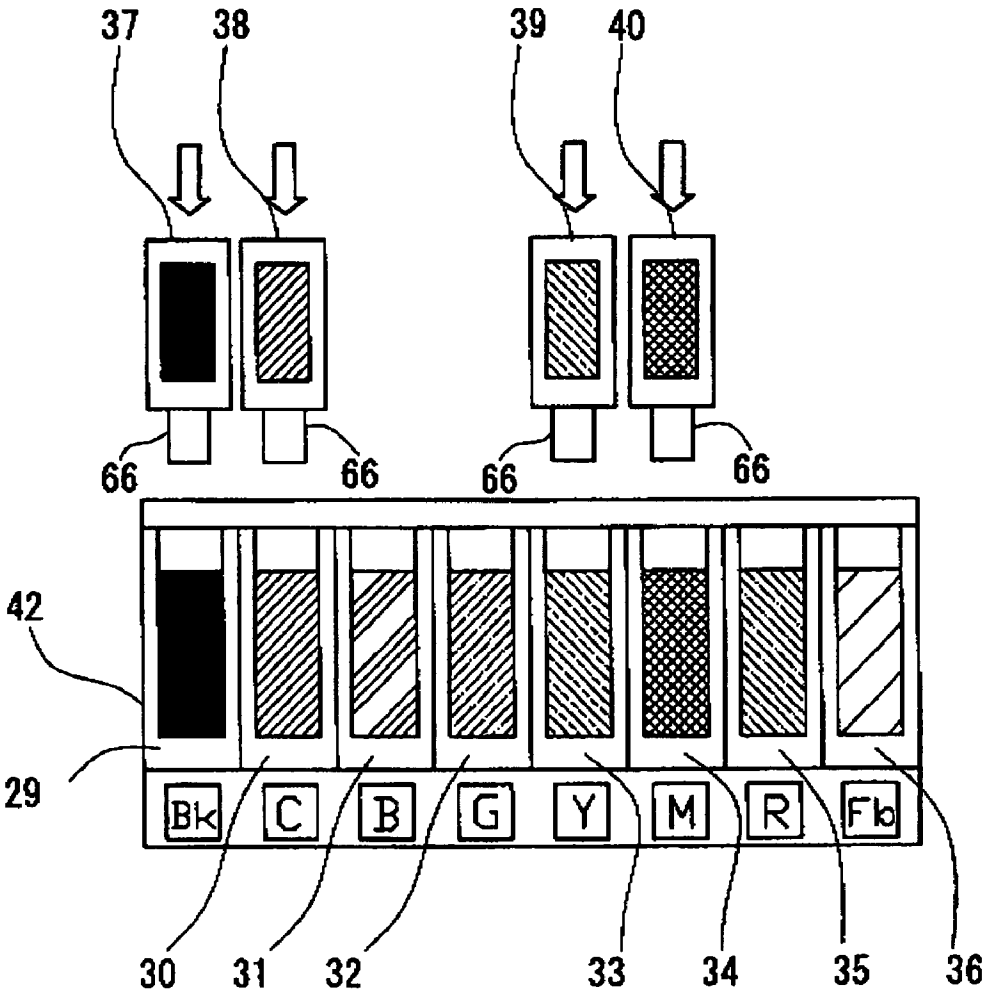
FIG. 16 is a view showing the color arrangements of ink tanks and sub-tanks according to certain illustrative aspects of the invention.

In FIG. 16 the color arrangement of the sub-tanks 29 to 36 is, in order from the left, Bk ink, C ink, B ink, G ink, Y ink, M ink, R ink and Fb ink. The color arrangement of the ink tanks 37 to 40 is, in order from the left in FIG. 16, Bk ink, C ink, Y ink and M ink, and the ink tanks 37 to 40 are disposed facing the corresponding inks in the sub-tanks 29 to 32. That is, although the array pitch between the ink tanks 37, 38 and the array pitch between the ink tanks 39, 40 are the same as the array pitch of the sub-tanks 29 to 36, the array pitch between the ink tanks 38, 39 is three times the array pitch of the sub-tanks 29 to 36.

Figure 17:
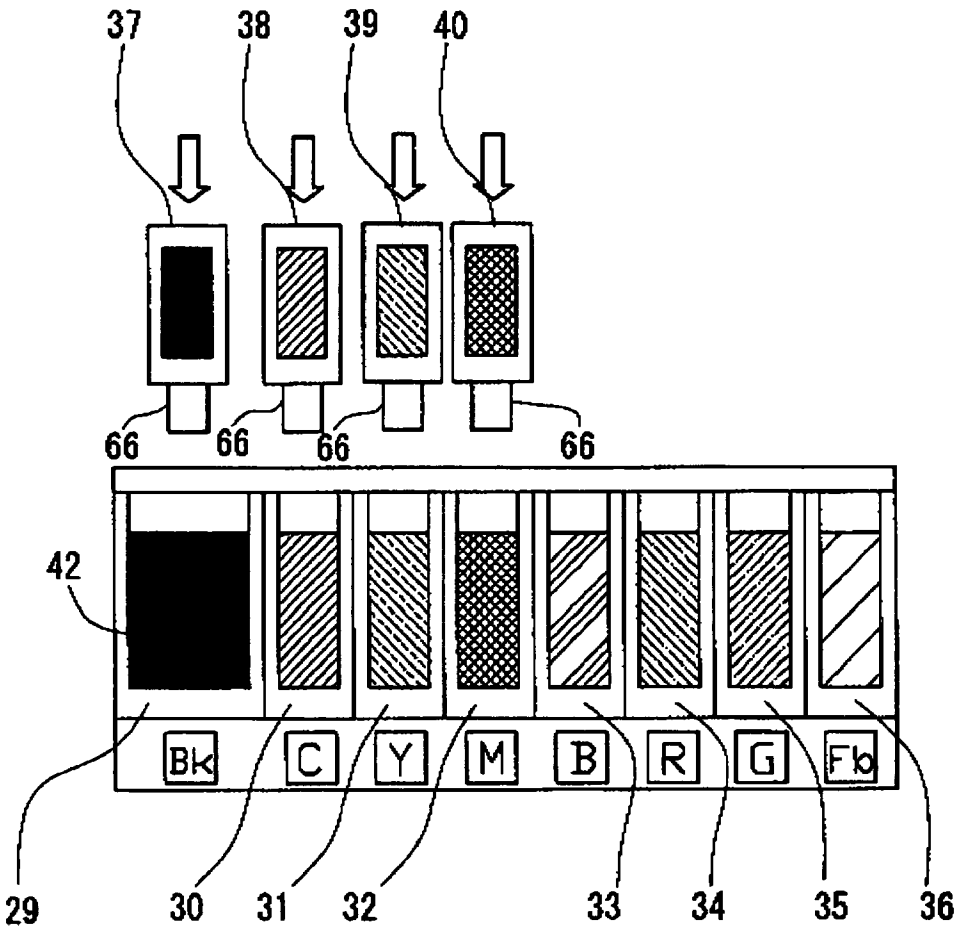
FIG. 17 is a view showing the color arrangements of ink tanks and sub-tanks according to certain illustrative aspects of the invention.

In FIG. 17, the color arrangement of the sub-tanks 29 to 32 and the color arrangement of the ink tanks 37 to 40 are the same as the color arrangements shown in FIG. 9, but the size (capacity) of the sub-tank 29 (Bk ink) has been made larger than the size (capacity) of the other sub-tanks 30 to 36.

Also when the color arrangement of the sub-tanks 29 to 32 and the color arrangement of the ink tanks 37 to 40 are arrangements shown in FIG. 15 to FIG. 17, the four basic inks can be fed into the basic color sub-tanks 29 to 32 simultaneously. Therefore, the basic inks can be supplied into the basic color sub-tanks 29 to 32 quickly, and as a result the time taken to supply the total of eight inks into the sub-tanks 29 to 36 can be shortened.

Aspects of the invention can be applied to an inkjet recording apparatus and to a multi-function device MFD including a printer portion and a scanner portion 12.

What is claimed is:

1. An ink jet recording apparatus comprising:

plural ink tanks, each tank being configured to store and supply a different basic ink;

plural sub-tanks coupled to the ink tanks and configured to receive at least one of the basic inks supplied from the ink tanks;

an inkjet recording head for receiving ink from the sub-tanks and configured to discharge the ink onto a recording medium;

a carriage configured to hold the sub-tanks and the inkjet recording head, and configured to move the sub-tanks relative to the ink tanks to allow ink from the ink tanks to be supplied to the sub-tanks; and a controller configured to control movement of the carriage and to control which of the basic inks are supplied from the ink tanks to the sub tanks, wherein at least one of the basic inks from the ink tanks is supplied to more than one of the sub-tanks, and wherein the controller controls the supply of the basic inks from the ink tanks to the sub-tanks in order from paler inks to darker inks.

2. The ink jet recording apparatus according to claim 1, including n ink tanks and m sub-tanks, wherein m>n.

3. The ink jet recording apparatus according to claim 2, wherein the n ink tanks and the m sub-tanks are each configured in an array, the array pitch of the n ink tanks and the array pitch of the m sub-tanks being the same.

4. The ink jet recording apparatus according to claim 2, wherein each of the n ink tanks has a connecting portion configured to be connected to any of the m sub-tanks and a valve provided to the connecting portion configured to prevent the basic ink from flowing out of the ink tank, and each of the m sub-tanks has a valve-opening portion configured to open the valve when the sub-tank is connected to the connecting portion.

5. The ink jet recording apparatus according to claim 2, wherein the controller is configured to control the supply of basic inks from the n ink tanks to the m sub-tanks, and wherein the basic inks in the n ink tanks are respectively supplied to n of the m sub-tanks to form n basic sub-tanks and a plurality of the basic inks are supplied from the n ink tanks to the m-n sub-tanks to form m-n mixed sub-tanks.

6. The ink jet recording apparatus according to claim 2, further including a pump for supplying the basic inks from the n ink tanks to the m sub-tanks.

7. The ink jet recording apparatus according to claim 6, wherein the controller is configured to control the pump.

8. The ink jet recording apparatus according to claim 2, further including means for supplying the basic inks from the n ink tanks to the m sub-tanks.

9. The ink jet recording apparatus according to claim 8, wherein the controller is configured to control the supplying means.

10. An ink jet recording apparatus comprising:

plural ink tanks, each tank being configured to store and supply a different basic ink;

plural sub-tanks coupled to the ink tanks and configured to receive at least one of the basic inks supplied from the ink tanks;

an inkjet recording head for receiving ink from the sub-tanks and configured to discharge the ink onto a recording medium;

a carriage configured to hold the sub-tanks and the inkjet recording head, and configured to move the sub-tanks relative to the ink tanks to allow ink from the ink tanks to be supplied to the sub-tanks;

means for supplying the basic inks from the ink tanks to the sub-tanks; and a controller configured to control movement of the carriage and to control which of the basic inks are supplied from the ink tanks to the sub tanks, wherein at least one of the basic inks from the ink tanks is supplied to more than one of the sub-tanks, and the controller is further configured to control the supplying means and the carriage to supply the basic inks from the tanks to the sub-tanks in order from paler inks to darker inks.

11. The ink jet recording apparatus according to claim 10, including n ink tanks and m sub-tanks, wherein m>n.

12. The ink jet recording apparatus according to claim 11, wherein the n ink tanks and the m sub-tanks are each configured in an array, the array pitch of the n ink tanks and the array pitch of the m sub-tanks being the same.

13. The ink jet recording apparatus according to claim 11, wherein each of the n ink tanks has a connecting portion configured to be connected to any of the m sub-tanks and a valve provided to the connecting portion configured to prevent the basic ink from flowing out of the ink tank, and each of the m sub-tanks has a valve-opening portion configured to open the valve when the sub-tank is connected to the connecting portion.

14. The ink jet recording apparatus according to claim 11, wherein the controller is configured to control the supply of basic inks from the n ink tanks to the m sub-tanks, and wherein the basic inks in the n ink tanks are respectively supplied to n of the m sub-tanks to form n basic sub-tanks and a plurality of the basic inks are supplied from the n ink tanks to the m-n sub-tanks to form m-n mixed sub-tanks.

15. The ink jet recording apparatus according to claim 11, further including a pump for supplying the basic inks from the n ink tanks to the m sub-tanks.

16. The ink jet recording apparatus according to claim 15, wherein the controller is configured to control the pump.

* * * * *

UNITED STATES PATENT AND TRADEMARK OFFICE

CERTIFICATE OF CORRECTION

PATENT NO. : 7,641,326 B2
APPLICATION NO. : 11/386095
DATED : January 5, 2010
INVENTOR(S) : Umeda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 689 days.

Signed and Sealed this

Sixteenth Day of November, 2010

David J. Kappos

David J. Kappos
*Director of the United States Patent and Trademark Office*